US011491516B2

(12) United States Patent
Dehn

(10) Patent No.: US 11,491,516 B2
(45) Date of Patent: Nov. 8, 2022

(54) VACUUM SPRAY APPARATUS AND USES THEREOF

(71) Applicant: ECP Incorporated, Woodridge, IL (US)

(72) Inventor: Dennis Dehn, Dallas, TX (US)

(73) Assignee: ECP Incorporated, Woodridge, IL (US)

( * ) Notice: Subject to any disclaimer, the term of this patent is extended or adjusted under 35 U.S.C. 154(b) by 281 days.

(21) Appl. No.: 16/682,519

(22) Filed: Nov. 13, 2019

(65) Prior Publication Data

US 2020/0130023 A1 Apr. 30, 2020

Related U.S. Application Data

(62) Division of application No. 14/321,196, filed on Jul. 1, 2014, now Pat. No. 10,562,078.

(Continued)

(51) Int. Cl.
*B08B 3/02* (2006.01)
*B05B 3/00* (2006.01)

(Continued)

(52) U.S. Cl.
CPC ..... *B08B 3/026* (2013.01); *B05B 3/00* (2013.01); *B05B 3/022* (2013.01); *B05B 3/06* (2013.01);

(Continued)

(58) Field of Classification Search
CPC ..... B08B 3/026; B08B 3/028; B08B 5/02; B08B 5/04; B08B 2203/0217;

(Continued)

(56) References Cited

U.S. PATENT DOCUMENTS 1,720,165 A 7/1929 Neff
2,270,579 A 1/1942 Bassett (Continued)

FOREIGN PATENT DOCUMENTS

DE 1806634 5/1970
EP 2255885 12/2010

(Continued)

OTHER PUBLICATIONS

Co-Pending U.S. Appl. No. 16/257,943 entitled, "Nozzle System and Method" to Endo filed Jan. 25, 2019.

(Continued)

*Primary Examiner* — Robert J Scruggs
(74) *Attorney, Agent, or Firm* — Kowert, Hood, Munyon, Rankin & Goetzel, P.C.; Gareth M. Sampson

(57) ABSTRACT

Spray apparatus and uses thereof are described herein. A vacuum spray nozzle apparatus may include a first tube in fluid communication with a fluid source, a rotor coupled to the tube, a conduit in fluid communication with the passages of the first tube, and a second tube coupled to the conduit, the second tube being in fluid communication with a vacuum source. The rotor is in fluid communication with the pressurized fluid source. The conduit is substantially arched or angled such that an outlet of the conduit is offset a radial distance in a radial direction from the rotor axis, and when pressurized fluid is ejected from the outlet, during use, rotates the conduit. The vacuum spray nozzle apparatus is configured to remove components from a material through the second tube when a pressure of the system is reduced using the vacuum source.

17 Claims, 18 Drawing Sheets

Related U.S. Application Data

(60) Provisional application No. 61/898,186, filed on Oct. 31, 2013, provisional application No. 61/841,768, filed on Jul. 1, 2013.

(51) Int. Cl.

| | |
|---|---|
| ***B05B 7/24*** | (2006.01) |
| ***B05B 3/02*** | (2006.01) |
| ***B24C 3/06*** | (2006.01) |
| ***B05B 3/06*** | (2006.01) |
| ***B08B 5/02*** | (2006.01) |
| ***B08B 5/04*** | (2006.01) |
| *B05B 7/06* | (2006.01) |
| *B05B 14/30* | (2018.01) |

(52) U.S. Cl.
CPC ..... *B05B 7/2435* (2013.01); *B08B 3/028* (2013.01); *B08B 5/02* (2013.01); *B08B 5/04* (2013.01); *B24C 3/065* (2013.01); *B05B 7/066* (2013.01); *B05B 14/30* (2018.02); *B08B 2203/0217* (2013.01); *B08B 2203/0229* (2013.01)

(58) Field of Classification Search
CPC ..... B08B 2203/0229; B05B 3/00; B05B 3/06; B05B 3/022; B05B 7/2435; B05B 7/066; B05B 15/0425; B05B 3/02; B24C 3/065; H01L 21/67028; H01L 21/67051; A47L 11/34; A47L 11/36; A47L 11/4088
See application file for complete search history.

(56) References Cited

U.S. PATENT DOCUMENTS

| | | | | |
|---|---|---|---|---|
| 2,679,084 | A | 5/1954 | Heitt | |
| 2,933,093 | A | 4/1960 | Handyside | |
| 3,727,949 | A | 4/1973 | Kleykamp | |
| 4,044,953 | A | 8/1977 | Vogel | |
| 4,369,850 | A | 1/1983 | Barker | |
| 4,370,771 | A | 1/1983 | Gonzalvo | |
| 4,841,760 | A | 6/1989 | Ferguson | |
| 5,052,623 | A | 10/1991 | Nordeen | |
| 5,533,673 | A | 7/1996 | Wilson et al. | |
| 5,725,153 | A | 3/1998 | Wang et al. | |
| 5,795,626 | A | 8/1998 | Gabel et al. | |
| 5,898,970 | A * | 5/1999 | Straiton | B05B 1/28 15/321 |
| 6,003,787 | A | 12/1999 | Fisher | |
| 6,126,086 | A | 10/2000 | Browner et al. | |
| 6,178,570 | B1 | 1/2001 | Denst et al. | |
| 6,490,753 | B1 | 12/2002 | Chen | |
| 6,609,269 | B2 | 8/2003 | Kasper | |
| 6,860,437 | B1 | 3/2005 | Amendt et al. | |
| 6,883,732 | B2 | 4/2005 | Hasegawa | |
| 7,032,837 | B2 | 4/2006 | Eddins et al. | |
| 7,225,503 | B1 | 6/2007 | Lenkiewicz et al. | |
| 7,458,485 | B2 | 12/2008 | Amron | |
| 7,530,474 | B2 | 5/2009 | Amron | |
| 7,568,635 | B2 | 8/2009 | Micheli | |
| 7,753,059 | B2 | 7/2010 | Hasegawa | |
| 7,784,148 | B2 | 8/2010 | Lenkiwicz et al. | |
| 7,878,423 | B2 | 2/2011 | Hasegawa | |
| 8,336,789 | B2 | 12/2012 | Kuo | |
| 8,353,467 | B2 | 1/2013 | Hasegawa | |
| 8,480,011 | B2 | 7/2013 | Endo | |
| 8,534,301 | B2 | 9/2013 | Nottingham | |
| 8,690,077 | B2 | 4/2014 | Endo | |
| 8,807,453 | B2 * | 8/2014 | Hsieh | B05B 3/1035 239/226 |
| 8,985,360 | B2 | 3/2015 | Chen | |
| 9,144,810 | B2 | 9/2015 | Bosua | |
| 9,211,560 | B1 | 12/2015 | Chen | |
| 9,475,071 | B2 | 10/2016 | Endo | |
| 9,597,694 | B2 | 3/2017 | Bosua | |
| 10,182,696 | B2 | 1/2019 | Dehn | |
| 10,189,034 | B2 | 1/2019 | Endo | |
| 10,343,177 | B1 | 7/2019 | Endo | |
| 2003/0029933 | A1 | 2/2003 | Hasegawa | |
| 2003/0182755 | A1 * | 10/2003 | Dicioccio | B60S 3/008 15/353 |
| 2003/0213481 | A1 | 11/2003 | Bell | |
| 2004/0149836 | A1 | 8/2004 | Herhold | |
| 2004/0177469 | A1 * | 9/2004 | Sadaune | B08B 3/026 15/322 |
| 2005/0173559 | A1 | 8/2005 | Eddins et al. | |
| 2006/0065760 | A1 | 3/2006 | Micheli | |
| 2006/0208104 | A1 | 9/2006 | DeBoer | |
| 2008/0048056 | A1 | 2/2008 | Pichler | |
| 2008/0197067 | A1 | 8/2008 | Ross et al. | |
| 2009/0057443 | A1 * | 3/2009 | Sendo | B05B 7/2435 239/405 |
| 2009/0065607 | A1 | 3/2009 | Gardner | |
| 2009/0078293 | A1 * | 3/2009 | Hasegawa | B08B 15/04 134/109 |
| 2009/0188067 | A1 | 7/2009 | White et al. | |
| 2009/0208367 | A1 | 8/2009 | Calio | |
| 2010/0176219 | A1 * | 7/2010 | Hasegawa | B05B 3/00 239/407 |
| 2010/0320289 | A1 | 12/2010 | Kuo | |
| 2011/0132405 | A1 * | 6/2011 | Lowenstein | E04D 13/0765 134/21 |
| 2011/0232685 | A1 | 9/2011 | Paffrath | |
| 2012/0286065 | A1 | 11/2012 | Lin | |
| 2012/0286071 | A1 | 11/2012 | Lin | |
| 2013/0001318 | A1 | 1/2013 | Sendo | |
| 2014/0008457 | A1 | 1/2014 | Bosua | |
| 2014/0061334 | A1 | 3/2014 | Liao | |
| 2014/0083467 | A1 | 3/2014 | Dehn | |
| 2014/0224278 | A1 | 8/2014 | Endo | |
| 2015/0000705 | A1 | 1/2015 | Dehn | |
| 2015/0375272 | A1 | 12/2015 | Dehn | |
| 2017/0113234 | A1 | 4/2017 | Endo | |
| 2019/0191953 | A1 | 6/2019 | Dehn | |
| 2019/0193094 | A1 | 6/2019 | Endo | |

FOREIGN PATENT DOCUMENTS

| | | |
|---|---|---|
| EP | 2587082 | 5/2013 |
| JP | H0437635 | 2/1992 |
| JP | H10286494 | 10/1998 |
| JP | H11123350 | 5/1999 |
| JP | 200051800 | 2/2000 |
| JP | 2001104840 | 4/2001 |
| JP | 2003154294 | 5/2003 |
| JP | 2007228900 | 9/2007 |
| JP | 2007228901 | 9/2007 |
| TW | 242279 | 3/1995 |
| TW | M260325 | 4/2005 |
| TW | 200603895 | 2/2006 |
| TW | 200840650 | 10/2008 |
| TW | 201244828 | 11/2012 |
| TW | M442195 | 12/2012 |
| TW | M472566 | 2/2014 |
| TW | 201524609 | 7/2015 |
| TW | I617360 | 3/2018 |
| WO | 1996013333 | 5/1996 |
| WO | 1997039620 | 10/1997 |
| WO | 2007006074 | 1/2007 |
| WO | 2007131533 | 11/2007 |
| WO | 2013060794 | 5/2013 |
| WO | 2013140173 | 9/2013 |

OTHER PUBLICATIONS

Final Office Action for U.S. Appl. No. 14/321,196 dated Dec. 20, 2018.

Non-Final Office Action for U.S. Appl. No. 14/801,325 dated Dec. 13, 2018.

Final Office Action for U.S. Appl. No. 14/801,325 dated Apr. 4, 2019.

(56) References Cited

OTHER PUBLICATIONS

Non-Final Office Action for U.S. Appl. No. 16/257,943 dated Apr. 2, 2019.
Co-Pending U.S. Appl. No. 16/251,849 entitled, "Steam Nozzle System and Method" to Dehn filed Jan. 18, 2019.
Non-Final Office Action for U.S. Appl. No. 14/182,012 dated Sep. 18, 2015.
Final Office Action for U.S. Appl. No. 14/182,012 dated Mar. 7, 2016.
Non-Final Office Action for U.S. Appl. No. 13/922,463 dated Sep. 29, 2016.
Non-Final Office Action for U.S. Appl. No. 13/922,463 dated May 16, 2017.
Final Office Action for U.S. Appl. No. 13/922,463 dated Nov. 1, 2017.
Non-Final Office Action for U.S. Appl. No. 14/321,196 dated Apr. 17, 2017.
Final Office Action for U.S. Appl. No. 14/321,196 dated Oct. 2, 2017.
First Office Action for Taiwanese Application No. 103135808 dated approximately Feb. 27, 2017.
Non-Final Office Action for U.S. Appl. No. 14/801,325 dated Oct. 3, 2017.
Notice of Allowance for U.S. Appl. No. 16/257,943 dated May 6, 2019.
Non-Final Office Action for U.S. Appl. No. 16/418,347 dated Sep. 30, 2019.
Non-Final Office Action for U.S. Appl. No. 14/321,196 dated Apr. 29, 2019.
NPL06_Petition of Invalidation Action for Taiwanese Application No. 103135808 dated approximately Sep. 2, 2019.
Non-Final Office Action for U.S. Appl. No. 14/801,325 dated Sep. 29, 2019.
Non-Final Office Action for U.S. Appl. No. 12/204,646 dated Sep. 29, 2010.
Final Office Action for U.S. Appl. No. 12/204,646 dated Mar. 2, 2011.
Non-Final Office Action for U.S. Appl. No. 12/204,646 dated Jun. 20, 2011.
Final Office Action for U.S. Appl. No. 12/204,646 dated Nov. 25, 2011.
Non-Final Office Action for U.S. Appl. No. 12/204,646 dated Oct. 4, 2012.
Final Office Action for U.S. Appl. No. 12/204,646 dated Apr. 12, 2013.
Non-Final Office Action for U.S. Appl. No. 13/530,987 dated Apr. 11, 2013.
Final Office Action for U.S. Appl. No. 13/530,987 dated Oct. 21, 2013.
Non-Final Office Action for U.S. Appl. No. 10/084,629 dated Apr. 1, 2003.
Final Office Action for U.S. Appl. No. 10/084,629 dated Nov. 3, 2003.
Notice of Allowance for U.S. Appl. No. 12/204,646 dated May 17, 2013.
Notice of Allowance for U.S. Appl. No. 13/530,987 dated Jan. 9, 2014.
Notice of Allowance for U.S. Appl. No. 14/182,012 dated Jul. 6, 2016.
Final Office Action for U.S. Appl. No. 16/418,347 dated Jan. 13, 2020.
Notice of Allowance for U.S. Appl. No. 16/418,347 dated May 22, 2020.
Notice of Allowance for U.S. Appl. No. 10/084,629 dated Jul. 7, 2004.
Advisory Action for U.S. Appl. No. 14/321,196 dated Jan. 16, 2018.
Advisory Action for U.S. Appl. No. 14/321,196 dated Mar. 22, 2019.
NOA for U.S. Appl. No. 14/321,196 dated Oct. 9, 2019.
Advisory Action for U.S. Appl. No. 14/801,325 dated Jul. 16, 2019.
Final Office Action for U.S. Appl. No. 14/801,325 dated May 21, 2020.
Non-Final Office Action for U.S. Appl. No. 15/293,987 dated Jun. 15, 2018.
Advisory Action for U.S. Appl. No. 14/801,325 dated Jul. 16, 2018.
NPL05_Claim Construction Order from United States District Court Central District of California, *Total Import Solutions, Inc.* v. *Dehn's Innovations LLC*, Judge Andre Birotte Jr., Case No. CV 17-03917-AB (AFMx) issued Jul. 11, 2018, pp. 19.
Notice of Allowance for U.S. Appl. No. 15/293,987 dated Oct. 1, 2018.
Advisory Action for U.S. Appl. No. 13/922,463 dated Feb. 13, 2018.
Notice of Allowance for U.S. Appl. No. 13/922,463 dated Sep. 12, 2018.
NPL04—https://omnexus.specialchem.com/product-categories/thermoplastics-pp-polypropylene#Patents.
Non-Final Office Action for U.S. Appl. No. 13/922,463 dated Mar. 19, 2018.
Non-Final Office Action for U.S. Appl. No. 14/321,196 dated Mar. 15, 2018.
NPL02_Notice of Allowance for Taiwanese Application No. 103135808 dated approximately Dec. 12, 2017.
NPL03_Petition of Invalidation Action for Taiwanese Application No. 103135808 dated approximately May 16, 2018.
Final Office Action for U.S. Appl. No. 14/801,325 dated Mar. 8, 2018.

* cited by examiner

VACUUM SPRAY APPARATUS AND USES THEREOF

PRIORITY CLAIM

This application is a divisional of U.S. patent application Ser. No. 14/321,196 filed Jul. 1, 2014, which claims priority to U.S. Provisional Application Ser. No. 61/841,768 filed Jul. 1, 2013 and U.S. Provisional Application Ser. No. 61/898,186 filed Oct. 31, 2013, both of which are incorporated herein by reference in its entirety.

BACKGROUND

1. Field of the Invention

The present invention relates to a rotary spray nozzle for ejecting or dispersing a jet of pressurized fluid and/or other medium. More particularly, the present invention relates to a vacuum rotary spray nozzle.

2. Description of Related Art

Many devices have been used for cleaning dust and dirt from a surface. Some such devices clean a surface by spraying a gas (e.g., compressed air) from an opening of a nozzle in a cleaning device. Other devices clean a surface by forcing a liquid, a powder, or a granular polishing agent through an opening of the device using a high-pressure air. Conventional devices tend to have a structure that forces high-pressure air and/or a cleaning fluid or other medium through a nozzle of the device.

Many conventional devices have been used for cleaning dirt or grime from a surface using high pressure air as source to rotate a nozzle and to generate suction for delivery of cleaning fluid to a material. For example, Japanese Publication No. 2000-51800; Japanese Publication No. H11-123350; Japanese Publication No. H04-37635; Japanese Publication No. H10-286494; and Japanese Publication No. 2001-104840; U.S. Pat. No. 6,883,732 to Hasegawa and U.S. Pat. No. 7,568,635 to Micheli; U.S. Patent Application Publication No. 2009/0057443 to Sendo and 2013-0001318 to Sendo; International Publication No. 2007/131533 to Jager; and European Patent Application Publication No. 2255885 to Bosua, all of which are incorporated herein by reference, describe spray guns used to dispense liquids for cleaning material.

U.S. Pat. No. 7,225,503 to Lenkiewicz et al. describes a liquid extraction cleaner for applying cleaning fluid to a surface, agitating the surface, and, then extracting the applied fluid therefrom. The cleaner includes a solution dispensing system, a liquid recovery system, and an agitation brush assembly. The solution dispensing system includes a supply tank removably affixed to a housing and fluidly connected to a fluid distributor through a trigger-operated manual spray pump. The liquid recovery system includes a recovery tank removably mounted to the housing adjacent to the supply tank. An air liquid separator is provided within the recovery tank. Another assembly within the housing provides a vacuum source, where working air comes from the recovery tank to an inlet between a motor and an impeller. The agitation brush assembly is removably mounted in a lower forward portion of the housing.

U.S. Pat. No. 6,609,269 to Kasper describes an extraction cleaning apparatus that includes a base housing, a fluid recovery system that includes a tank having a fluid recovery chamber for holding recovered fluid, a working air conduit, an above floor accessory hose mounted at one end to the housing for optional above floor cleaning, and a unitary duct mounted to the housing and connected at a first end to the accessory hose one end and, at another end, connected to the working air conduit at an accessory hose inlet a conversion valve in the working air conduit between the suction nozzle and the accessory hose inlet to selectively connect the vacuum source to either the suction nozzle or to the accessory hose. Portions of the unitary duct are flat and an intermediate portion of the unitary duct extends beneath the recovery tank.

Theses conventional detergent and steam cleaning systems are somewhat effective at cleaning surface, but could be made more effective by being able to clean and extract at ambient temperatures.

SUMMARY

Various embodiments of a vacuum spray apparatus and methods of use are described herein. In some embodiments, a vacuum spray apparatus includes: a first tube in fluid communication with a fluid source; a rotor coupled to the tube, wherein the rotor is in fluid communication with the pressurized fluid source; a conduit in fluid communication with the passages of the first tube, and the rotor, wherein the conduit is substantially arched or angled such that an outlet of the conduit is offset a radial distance in a radial direction from the rotor axis, wherein pressurized fluid ejected from the outlet, during use, rotates the conduit; and a second tube coupled to the conduit, the second tube being in fluid communication with a vacuum source. The vacuum spray apparatus is configured to remove components from a material through the second tube when a pressure of the system is reduced using the vacuum source.

In some embodiments, a method of cleaning one or more materials includes providing air from a vacuum spray apparatus to one or more of the materials such that one or more compounds are dislodged from the material; and reducing the pressure inside the vacuum spray apparatus to a sufficient pressure so that at least one of the dislodged compounds is drawn into the vacuum spray apparatus. A portion of the air is provided as an aerosol spray.

In some embodiments, a method of cleaning one or materials includes providing medium from a vacuum spray apparatus to at least one of the materials such that one or more compounds are dislodged from the material, wherein a portion of the medium is provided as an aerosol spray; and reducing the pressure inside the vacuum spray apparatus to a sufficient pressure so that at least one of the dislodged compounds is drawn into the vacuum spray apparatus.

BRIEF DESCRIPTION OF THE DRAWINGS

Advantages of the present invention will become apparent to those skilled in the art with the benefit of the following detailed description and upon reference to the accompanying drawings.

Figure 1:
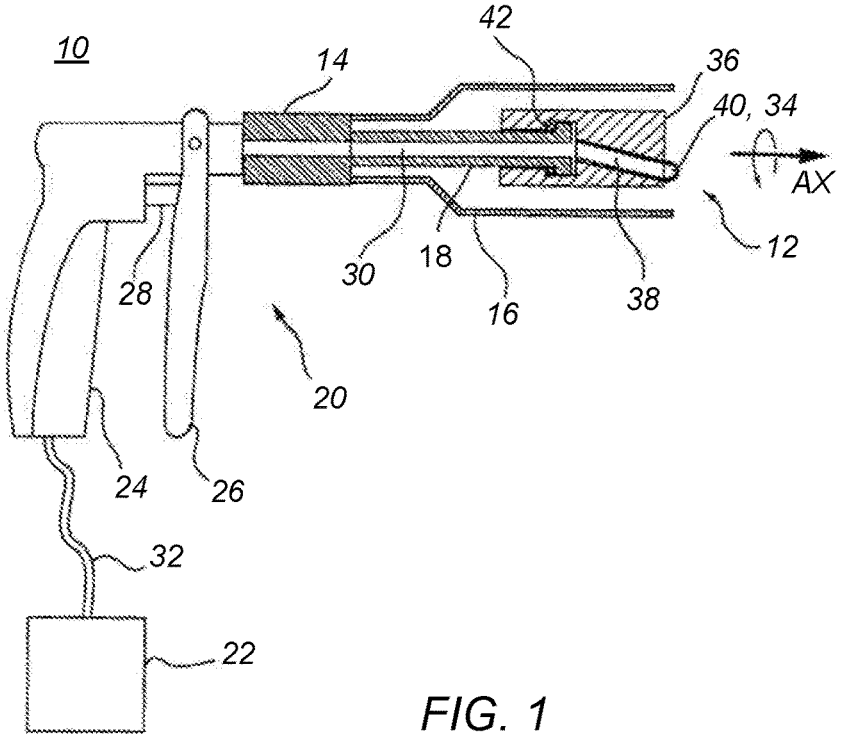
FIG. 1 depicts a partially longitudinally cross sectional schematic (side) view of an embodiment of a spray apparatus equipped with a spray apparatus.

While the invention is susceptible to various modifications and alternative forms, specific embodiments thereof are shown by way of example in the drawings and will herein be described in detail. The drawings may not be to scale. It should be understood, however, that the drawings and detailed description thereto are not intended to limit the invention to the particular form disclosed, but to the contrary, the intention is to cover all modifications, equivalents, and alternatives falling within the spirit and scope of the present invention as defined by the appended claims.

DETAILED DESCRIPTION OF ILLUSTRATIVE EMBODIMENTS

The spray nozzle described herein, eliminates problems described above relating to spray apparatus. The spray apparatus described herein provides a spray apparatus for ejecting and dispersing a jet of pressurized fluid from a rotating outlet, and, more particularly, a spray apparatus for allowing the distal end to be smoothly turned by the ejection of a small amount of a relatively low-pressure gas regardless of the environmental conditions (e.g., the temperature), while preventing fouling or wearing. In some embodiments, a spray apparatus described herein includes a rotary member made of a rigid material that includes a flow passage provided therein for producing a rotational force created by a counter force of the ejection of pressurized fluid. In some embodiments, a spray apparatus described herein includes a rotary member made of a flexible conduit having a flow passage provided therein for producing a rotational force created by a counter force of the ejection of pressurized fluid. The rotary member, in certain embodiments, is rotatably joined to a stationary tube that communicates with a pressurized fluid supply source such that the pressurized fluid can be ejected and dispersed without the use of a flexible tube or a horn-like guide. "Fluid" refers to gas and/or liquid. Examples, of fluid include air, water and/or steam.

The spray nozzle, in some embodiments, allows the rotary member constituting a portion of the passage of the pressurized fluid to be made of a rigid material, or substantially inflexible material, and rotatably joined to the distal end to the stationary tube, hence eliminating the problems residing in the conventional flexible spray nozzle that is rotatably arranged. That is, in certain embodiments, there is reduced or no collision or wear between the distal end of the nozzle and the inner side of the horn-like guide. Further, the rotation of the nozzle can start immediately upon the ejection of the pressurized fluid regardless of the temperature where used, in some embodiments.

In certain embodiments, the effect of increasing the pressure waves of the pressurized fluid are obtained with the nozzle starting rotation even if the pressure of the pressurized fluid is relatively low. Thus, in certain embodiments, ejection of the pressurized fluid can be applied to a delicate object, such as feather fabric.

Further, the spray nozzle, according to certain embodiments, is used as a dust blower that produces a jet of pressurized fluid to remove dusts from a target area at the extension of the axis of rotation while continuously applying a force of ejection onto a surrounding region about the area. In such an embodiment, even when the fabric or elastic object to be cleaned is fouled with dusts or sticky dirt, it can be cleaned by continuously applying the force of the ejection onto the surrounding region about the dust area, like hitting a futon fabric with a futon stick for lifting and removing dusts.

In some embodiments, the rotary member and the stationary tube may be joined rotatably to each other by a bearing. In such an embodiment, the inclusion of a bearing allows the rotating friction acting the rotary member to be reduced while the rotary member is stably rotated by the ejection of the pressurized fluid at a relatively lower pressure, a small amount, or at a lower temperature.

In other embodiments, the rotary member has two or more outlet ports provided at the opening end thereof and located symmetrically with respect to the axis of rotation. Such an embodiment permits counter forces in the radial direction of the ejection of the pressurized fluid to be balanced, thus, ensuring the stable rotation of the rotary member without being off-centered. In certain embodiments, the outlet ports equally face the direction of rotation, and the counter forces of the ejection of the pressurized fluid remains aligned in the direction of rotation, thus causing the rotary member to rotate in the direction opposite to the direction of the ejection.

In some embodiments, the rotary member has an axially blowing fan provided for producing an axial flow along the axis of the rotary member. Such embodiments may allow the pressurized fluid ejected from the outlet ports to be decreased in the component for rotation and increased in the axial component. Thus, in certain embodiments, the pressurized fluid can be prevented from over-dispersing while its ejection along the axial direction is increased.

In certain embodiments, the rotary member may include a brush that projects from the distal end thereof. In such an embodiment, the spray apparatus may directly sweep with the action of the brush in addition to providing a force due ejection of the pressurized fluid, thereby further improving the dust removing capability.

Further, in order to solve certain above-described problems, some embodiments of the present invention include a tip end of an outer tube constituting the spray nozzle having an inner/outer double tube structure that is formed in a passage of the rotating element and having a flow passage for the pressurized gas. In certain embodiments, the rotor, constituting a part of the flow passage of the pressurized gas, is made of the hard material and is rotatably fitted to the tip end of a fixed outer tube. In such an embodiment, it may be possible to solve the above-described problem of the conventional spray nozzle, in which the whole part of the flexible nozzle that moves unconstrained/unruly by the spray of the pressurized gas is rotated along the inner surface of the trumpet-shaped guide. In such an embodiment, by spraying pressurized gas of a small amount or at relatively low pressure, the rotating element can be rotated appropriately by an associated spray reaction force. In addition, in such an embodiment, there may be no deterioration of the nozzle and no corruption of the inner surface of the guide due to the friction between the nozzle and the inner surface of the guide. In such embodiments, the medium may be suctioned (drawn) and rotatory-diffused appropriately, independent of the temperature.

Therefore, in certain embodiments of the spray apparatus, the nozzle is stably rotated even by the spray of a small amount of pressurized gas and pressurized gas having a low pressure. Such embodiments help to prevent splashing of the medium and/or deviation of the medium from a spray target. These embodiments make it possible to achieve cleaning, painting, and blasting even when the spray target requires fine spray. In addition, in some embodiments, the pressure wave of the pressurized gas is amplified, thereby making it possible to obtain aerosol spray having a very small diameter, with the medium diffused appropriately, and also possible to spray this aerosol toward the spray target with a high spraying force.

In certain embodiments, a plurality of spray ports are opened and formed in the rotating element, and each spray port may be provided in a rotation symmetric position with respect to the rotary shaft. In such an embodiment, the reaction force about the diameter is balanced to allow the rotating element to rotate smoothly around the fixed outer tube, without being decentered (e.g., without wobbling). Further, by making each spray port be directed to the same rotational direction, the medium is sprayed in all directions around the rotary shaft in a balanced manner, and the spray reaction force of the pressurized gas received by each spray port is not canceled in the rotational direction, thus making it possible to rotate the rotating element.

In certain embodiments, an opening end of the tip end side of the inner tube for spraying the medium is disposed in the vicinity of the outlet ports or inside of the passage of the rotating element. In an embodiment in which the opening end of the inner tube is disposed inside of the negative pressure zone formed by the spray of the pressurized gas, the medium may be drawn from the medium supply source and delivered through the inner tube. Accordingly, in some embodiments, it may not be necessary to add to the medium supply source an inner pressure above the atmospheric pressure. Such an embodiment may help to simplify the spray apparatus and improve handleability.

In some embodiments, the rotating element and the fixed outer tube may be connected rotatably by bearing. Such an embodiment may help to reduce a rotational friction that acts on the rotating element, and the rotating element may be rotated appropriately even by a small amount of spray of the pressurized gas or even when being used at a low temperature.

In some embodiments, the spray nozzle has a flexible conduit

In certain embodiments, an axial flow fan may be provided for generating an axial flow in an axial direction of the rotating element. In such an embodiment, a rotation component of the gas sprayed from the rotating outlet ports is suppressed, thus increasing a component in the axial direction. In such an embodiment, where there may be excess spray of the pressurized gas in the radial direction that excessively diffuses the medium, the rotation of the rotating element can be suppressed by the axial flow fan and the spraying force in the axial direction can be increased.

In some embodiments, a brush may be disposed on and protrude from the tip end of the rotating element and/or the guide. In such an embodiment, when the spray apparatus of the present invention is used for cleaning and blasting, it may be possible to obtain a direct brushing effect for the spray target by using the brush. Such an embodiment may make it possible to further increase a dust removing performance or clean a blast surface.

In some embodiments, the spray nozzle is equipped with a vacuum attachment that allows the spray apparatus to be used under vacuum. The vacuum attachment includes one or more sealing members. The sealing members in the attachment allow the spray apparatus to be used with pressurized fluid and with vacuum with little to a minimal change in equipment. Use of the vacuum attachment in conjunction with the spray nozzle allows for efficient cleaning of materials.

FIG. 1 is a partially longitudinally cross sectional, schematic side view of an embodiment of a spray apparatus 10 that includes spray nozzle 12 at the distal end (at the right in the drawing). The arrangement of spray nozzle 12, joint 14, and cover 16 is illustrated in the longitudinally cross sectional view taken along the vertical line through along the axis of rotation (AX).

Figure 2A:
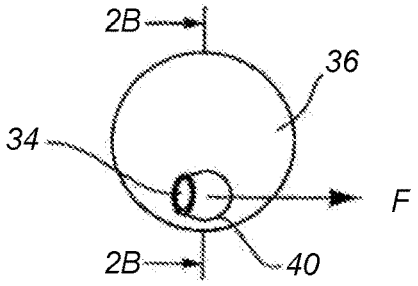
FIG. 2A depicts a front view of an embodiment of a spray nozzle.
Figure 2B:
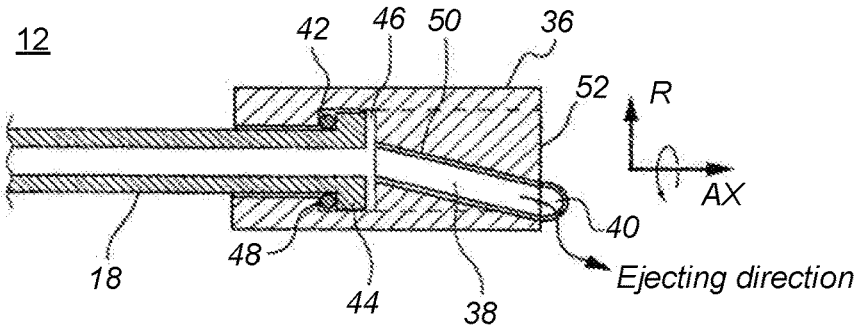
FIG. 2B depicts a cross sectional side view of the spray nozzle taken across line 2B-2B of FIG. 2A.

FIG. 2A is a front view of an embodiment of spray nozzle 12. FIG. 2B is a cross sectional view taken along the line 2B-2B of the FIG. 2A. The proximal end (at the left in the drawing) of fixed (stationary) tube 18 is not shown in FIG. 2A Spray apparatus 10 (e.g., a dust blower) ejects a jet of pressurized fluid to remove dusts and includes spray gun portion 20 and pressurized fluid/gas source 22. Pressurized fluid/gas source is for example, a compress air cylinder, air compressor, or other known sources of pressurized air.

Spray gun 20 includes gun main body 24, lever 26, and valve 28. Spray gun 20 is coupled to spray nozzle 12 and horn-like cover 16. Body 24 includes joint 14 having a pressurized fluid flow passage provided therein. Valve 28 allows communication between flow passage 30 and pressurized gas source 22. Spray nozzle 12 is connected to the distal end of joint 14. Horn-like cover 16 surrounds spray nozzle 12. Gun main body 24 and pressurized gas source 22 are communicated to each other by flexible tube 32.

In use, valve 28 opens flow passage 30 when lever 26 is pulled by the hand of an operator. Opening of valve 28 allows pressurized fluid stored in pressurized gas source 22 to flow through passage 30 and to be ejected from the distal end of spray nozzle 12. When lever 26 is returned back to its original position by user, valve 28 closes flow passage 30 to stop the flow of the pressurized fluid.

The pressurized fluid is not limited to compressed air, but may be selected from inert gases such as nitrogen, carbon dioxide, or chlorofluorocarbons. The pressure of the compressed fluid may range from a few MPa to tens of MPa. In one embodiment, when valve 28 opens, the pressurized fluid is de-pressurized to not greater than 1 MPa but higher than the atmospheric level, to be ejected from outlet port (air outlet) 34 of spray nozzle 12.

Spray nozzle 12 includes rotating element 36 that is rotatably joined to the distal end of fixed tube 18 which is fixedly joined to spray gun 20.

Fixed tube 18 is tightly joined (for example, air tight) at the proximal end (at the left in the drawing) to joint 14 for communication with pressurized gas source 22 with the hollow inside of the fixed tube serving as flow passage 30. The joint between the proximal end of fixed tube 18 and joint 14 is not particularly limited, but may be implemented by a combination of male thread provided on the outer side at the proximal end of the fixed tube and female thread provided in the distal end of the joint, which both are closely engaged with each other.

The shape along the centerline or in the cross section of fixed tube 18 is of no limitations although it has a circular shape in the illustrated cross section and is linearly extended along the centerline in the illustrated embodiment.

In some embodiments, the direction along which the distal end of fixed tube 18 extends or the center in the cross section of the fixed tube is matched with the axis of rotation (AX) of rotating element 36. As long as rotating element 36 is rotatable in relation to the distal end of fixed tube 18 and the pressurized fluid to be ejected does not leak from a gap between the fixed tube and the rotating element, the matching between the center line in the cross section of the fixed tube and axis of rotation of the rotating element is not mandatory. For example, the axis of rotation may be offset from the centerline of fixed tube 18 or the fixed tube may extend offset from or away from the axis of rotation.

Rotating element 36 has passage 38 provided therein for communication with fixed tube 18. Fixed tube 18 and rotating element 36 are joined to each other rotatably and air tightly, whereby the pressurized fluid derived from pressurized gas source 22 through the fixed tube may be conveyed through passage 38 to be ejected from nozzle tip 40.

Nozzle tip 40 is provided at the distal end (at the right in the drawing) of passage 38 in fluid communication with fixed tube 18. Nozzle tip 40 is positioned at a location which is offset a distance in the radial direction (R) from the axis of rotation (AX) of rotating element 36 as shown in FIG. 2B. Outlet port 34 in nozzle tip 40 has an opening in a direction which intersects both the axis of rotation and the radial direction. In other words, the ejection of the pressurized fluid which is normal to the opening of outlet port 34 is contemplated to produce directional components of the pressurized fluid along the direction of rotation about the axis of rotation.

Accordingly, when pressurized fluid stored in pressurized gas source 22 is ejected from the outlet port 34, the outlet port allows the nozzle tip 40 to receive a counter force F as shown in FIG. 2A and causes rotating element 36 with nozzle tip 40 to spin about the axis of rotation. As shown, outlet port 34 extends in a direction intermediate between the axis of rotation and the direction of rotation about the axis of rotation. This permits rotating element 36 with outlet port 34 to rotate counter-clockwise, as viewed from the front of the axis of rotation, when pressurized fluid is ejected from the outlet port.

Since outlet port 34 moves along a circle of which the radius is equal to the offset distance of nozzle tip 40 from the axis of rotation, its rotating action can amplify the pressure waves of the pressurized fluid ejected along the directional components about the axis of rotation.

Fixed tube 18 and rotating element 36 are made of a rigid material that remains significantly undeformed and is inflexible by the ejection of the pressurized fluid. Particularly, they may be made of a hard plastic material or a metallic material. In certain embodiments, fixed tube 18 is made of a metallic material such as stainless steel for increasing the resistance to pressure and the operational durability while rotating element 36 is made of a hard plastic material such as poly-urethane doped with a plasticizer in terms of lowering inertia moment and smoothly rotating.

As shown, fixed tube 18 and rotating element 36 are joined to each other by bearing 42, such as a roller bearing or a slider bearing.

As shown in FIG. 2B, fixed tube 18 has flange 44 provided at the distal end thereof. On the other hand, rotating element 36 has chamber 46 provided in the proximal end thereof for accepting flange 44 and bearing 42. Chamber 46 at the proximal end is defined by thick portion 48 which is sized smaller in the diameter than flange 44 and greater than fixed tube 18. With bearing 42 disposed between flange 44 and thick portion 48, fixed tube 18 and rotating element 36 are joined to each other so that they can rotate about the axis that extends across the center in the cross section of the fixed tube.

Pipe 50 is embedded in rotating element 36 for providing passage 38. Pipe 50 is arranged rotatably about the axis of rotating element 36 and its proximal end is matched with or substantially overlapped with the axis of rotation (AX). As pipe 50 is opened at the proximal end to chamber 46, the pipe communicates with passage 30 of fixed tube 18. Distal end of pipe 50 is situated at a location offset distanced from the axis of rotation while nozzle tip 40 is bent at the opening end such that outlet port 34 is configured to produce a directional component along (e.g., parallel to) the axis of rotation and directional component about the axis of rotation.

The material and shape of pipe 50 is not limited and may be implemented by a circular tube of hard plastic material. Although pipe 50 is a straight pipe tilted from the axis of rotation as illustrated, it may be implemented by a curved pipe or a bent pipe.

Spray nozzle 12 may be fabricated by the following procedure. In some embodiments, a diameter of a distal end of a metallic tube may be enlarged to form fixed tube 18 provided with flange 44. Rotating element 36 of a cylindrical shape which is sized smaller at the proximal end and greater at the distal end in the diameter is made from a hard plastic material. The smaller diameter at the proximal end of fixed tube 18 is matched with the inner diameter of thick portion 48 while the larger diameter at the distal end is matched with the inner diameter at chamber 46 as denoted by the broken line in FIG. 2B.

Fixed tube 18 is loaded at the outer side with bearings 42 being inserted from its distal end side into rotating element 36. Since the inner diameter of thick portion 48 of rotating element 36 is smaller than the diameter of flange 44 of fixed tube 18, the flange acts as a stopper so that the flange and the thick portion are abutted (e.g., coupled) to each other by bearings 42.

Pipe 50, which has been formed at the distal end in a given shape, is inserted from the distal end side into rotating element 36 and temporarily fixes pipe 50.

Rotating element 36 is filled with a melted form of resin material 52 to fix the temporarily fixed pipe 50 while its distal end is closed to develop chamber 46 therein. Resin material 52 injected into the distal end side of rotating element 36 may be the same as or different from that of the rotating element.

As described, fixed tube 18 and rotating element 36 are made of the rigid material and coupled to one another by one or more bearings 42, whereby their parts can hardly be deformed by a counter force of the ejection of the pressurized fluid hence eliminating the internal loss of the ejection energy of the pressurized fluid.

Since rotating element 36 is arranged of cylindrical shape about the axis of rotation with its nozzle tip 40 and outlet port 34 located in the area of the distal end side of rotating element 36, it provides no projections in radial directions when rotating and allows a user or other workers to use spray apparatus 10 of the present invention safely.

Cover 16 used in the present invention does not directly contact rotating element 36 and, as such, may not foul or wear the inner side of the rotating element. Cover 16 is not limited to any particular shape, so long as it does not directly contact rotating element 36 during the rotating action, but its distal end may be projected from outlet port 34 towards the front to form a visor for avoiding over-dispersion of the pressurized fluid ejected from the outlet port which is turning. For example, cover 16 is mounted to joint 14 in gun main body 24 (See, for example, FIG. 1). Cover 16 may be joined detachably to the gun main body 24.

In some embodiments, passage 38 may be provided by making a through bore in rotating element 36 of a solid form. Rotating element 36 may be composed of two separate parts that are joined to each other when fixed tube 18 and at least one bearing 42 have been assembled in the rotating element.

In some embodiments, pipe 50 may be exposed without being embedded completely in rotating element 36. That is, pipe 50 is made from a rigid material so that its distal end is radially offset by a distance from the axis of rotation and its opening has directional components along the direction of rotation and, thus, may be used as rotating element 36. In some embodiments, rotating element 36 may be joined to the distal end of fixed tube 18 slidably with no use of the bearing for rotating. Alternatively, both may be joined integrally by another axially rotatable member.

Figure 3A:
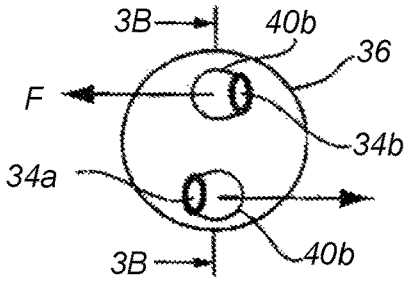
FIG. 3A depicts a front view of an embodiment of a spray nozzle with a plurality of outlets.
Figure 3B:
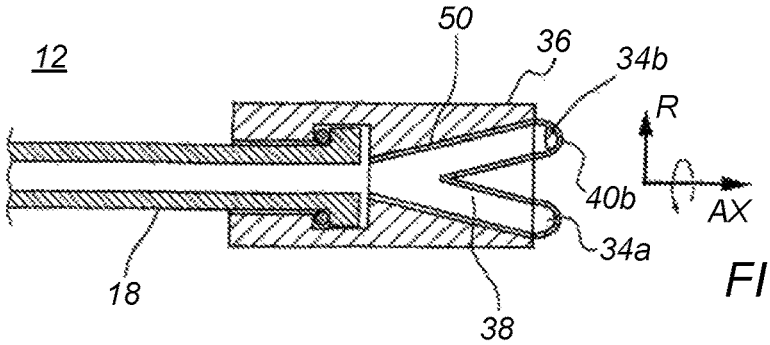
FIG. 3B depicts a cross sectional side view of the spray nozzle taken across line 3B-3B of FIG. 3A.

FIG. 3A is a front view of an embodiment of a spray nozzle 12. FIG. 3B is a partially longitudinally cross sectional schematic (side) view of cross-section taken along the line 3B-3B of FIG. 3A.

As shown in FIGS. 3A and 3B, pipe 50 embedded in rotating element 36 is divided into two sections which extend towards the distal end (at the right in the drawing) and bent at the distal end to form nozzle tips 40*a*, 40*b* having their respective outlet ports 34*a*, 34*b*.

Upper and lower halves of rotating element 36 are arranged symmetrically with respect to the axis of rotation (AX). Accordingly, two nozzle tips 40*a*, 40*b* with respective outlet ports 34*a*, 34*b* are located symmetrically with respect to the axis of rotation. Lower outlet port 34*a* is opened in a direction intermediate between the axis of rotation and the leftward direction in FIG. 3A. Upper outlet port 34*b* is opened in a direction intermediate between the axis of rotation and the rightward direction in FIG. 3A. In other words, the opening of each of two outlet ports 34*a*, 34*b* may be configured to produce directional components of the pressurized fluid along the direction of rotation and about the axis of rotation. This permits rotating element 36 to rotate counter-clockwise along the common direction of rotation, as viewed from the front of the axis of rotation and denoted by the arrow in FIG. 3A, when the pressurized fluid supplied through passage 38 in fixed tube 18 is ejected from outlet ports 34*a*, 34*b*.

In an embodiment in which outlet ports 34*a*, 34*b* are located symmetry with respect to the axis of rotation and their openings face the common direction of rotation, the counter forces of the ejection of the pressurized fluid at the direction components are summed up while the radial components of the pressurized fluid are offset by each other, rotating element 36 can smoothly rotate about the axis of rotation without being radially off centered from fixed tube 18 or oscillated in opposite directions.

In some embodiments, the outlet ports facing the common direction of rotation means that the counter force of the pressured air ejected from one of the two outlet ports is not interrupted and offset by the counter force of the pressurized fluid ejected from the other outlet port but not that the two outlet ports have the same opening direction. Similarly, the outlet ports may be located symmetrically with respect to the axis of rotation means that they are located substantially in balance about the axis of rotation.

While single pipe 50 has two branches provided with respective outlet ports 34*a*, 34*b* at the distal end, fixed tube 18 may be joined rotatably at the distal end to two or more pipes, each pipe having one outlet port, directly or indirectly by another connecting member. Alternatively, two or more passages 38 are provided in the solid rotating element 36 and communicated with their respective outlet ports 34*a*, 34*b* at the distal end as described previously.

Figure 4A:
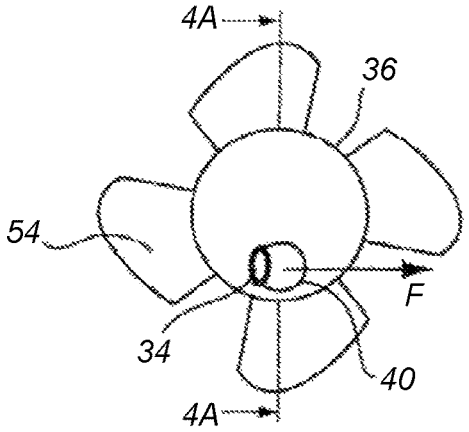
FIG. 4A depicts a front view of an embodiment of a spray nozzle with a fan.
Figure 4B:
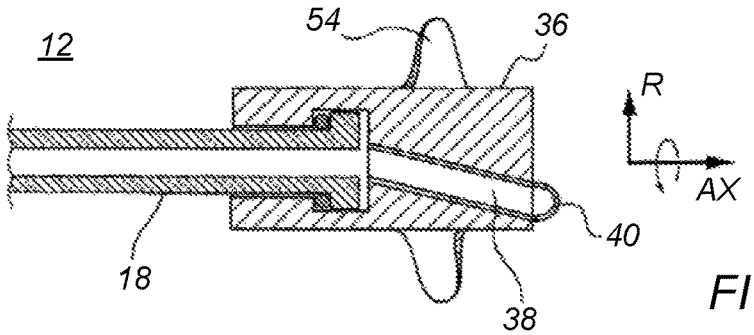
FIG. 4B depicts a cross sectional side view of the spray nozzle taken across line 4B-4B of FIG. 4A.

FIG. 4A is a front view of an embodiment of a spray nozzle 12. FIG. 4B is a partially longitudinally cross sectional schematic (side) view of cross-section taken along the line 4B-4B of FIG. 4A.

As shown in FIGS. 4A and 4B, rotating element 36 includes an axially blowing fan 54 provided on the outer side thereof so that fan 54 produces a flow of air along the axis of rotation (AX) as the rotating element is rotated by the ejection of the pressurized fluid.

Accordingly, in a case that the pressured air ejected along the radial direction (R) from outlet port 34 is too great and the flow of air along the axis of rotation (AX) is smaller, fan 54 on rotating element 36 produces an axial flow of which the counter force retards the rotating action of the rotating element, hence increasing the force of the ejection along the axis of rotation with the help of the axial flow.

That is, the action of fan 54 controls the over-rotating of rotating element 36 thus to attenuate the dispersion of the pressurized fluid and increases the force of the ejection along the axis of rotation. In this point of view, the action of the axially blowing fan on rotating element 36, in some embodiments, may convert the resistive flow produced on the rotating element into a propelling flow along the axis of rotation but not make the same into an energy loss, thus, assisting the ejection of the pressurized fluid, in addition to the use of the resistive flow for controlling the rotating of the rotating element, thus, enabling adjustment of the of the ejection force along the axis of rotation.

In some embodiments, fan 54 is detachably mounted to rotating element 36. This allows the ejection along the axis of rotation to be adjustably increased or decreased depending on the application of spray apparatus 10. In some embodiments, an angle of twist and a mounting angle of fan 54 may be varied in relation to rotating element 36.

Figure 5A:
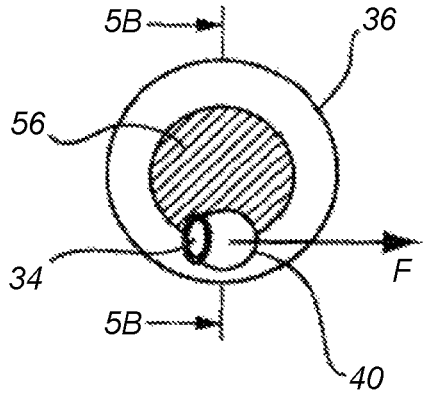
FIG. 5A depicts a front view of an embodiment of the spray nozzle with a brush.
Figure 5B:
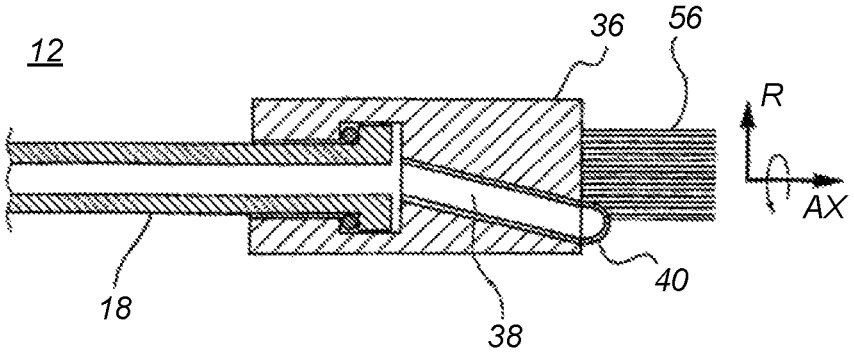
FIG. 5B depicts a cross sectional side view of the spray nozzle taken across line 5B-5B of FIG. 5A.

FIG. 5A is a front view of an embodiment of a spray nozzle 12. FIG. 5B is a partially longitudinally cross sectional schematic side view of cross-section taken along the line 5B-5B of FIG. 5A.

As shown in FIGS. 5A and 5B, rotating element 36 includes brush 56 disposed on and projecting from the distal end thereof. As rotating element 36 is rotated by the counter force F of the ejection of the pressurized fluid, brush 56 rotates about the axis of rotation to physically clean up the surface to be blown in the direction of rotation. Also, as brush 56 is urged in the radial direction by the expanding and rotatably dispersing the pressurized fluid ejected from outlet port 34, its cleaning effect involves a combination of blowing in both the direction of rotation and the radial direction of the pressurized fluid.

Accordingly, when spray apparatus 10 is used as a dust blower, spray nozzle 12 may eject a jet of the pressurized fluid with brush 56 rotating to physically sweep and move dusts stuck up to the surface to be blown, and, thus blow away the removed dusts.

Various methods of mounting brush 56 on rotating element 36 may be employed. As shown, brush 56 is located closer to the axis of rotation (AX) than outlet port 36 and may thus prevent the pressurized fluid ejected from the outlet port from flowing towards the axis of rotation (towards the center) and permit the dusts accumulated across the extension of the axis of rotation to be blown by the surrounding jet of the pressurized fluid ejected from the outlet port, whereby the advantage of lifting and removing the dust will be enhanced.

Brush 56 may be mounted to the circumferential side of rotating element 36, but not limited to its mounting on the distal end of the rotating element as shown in the drawing, and projected at the distal end outwardly of outlet port 34.

Figure 6:
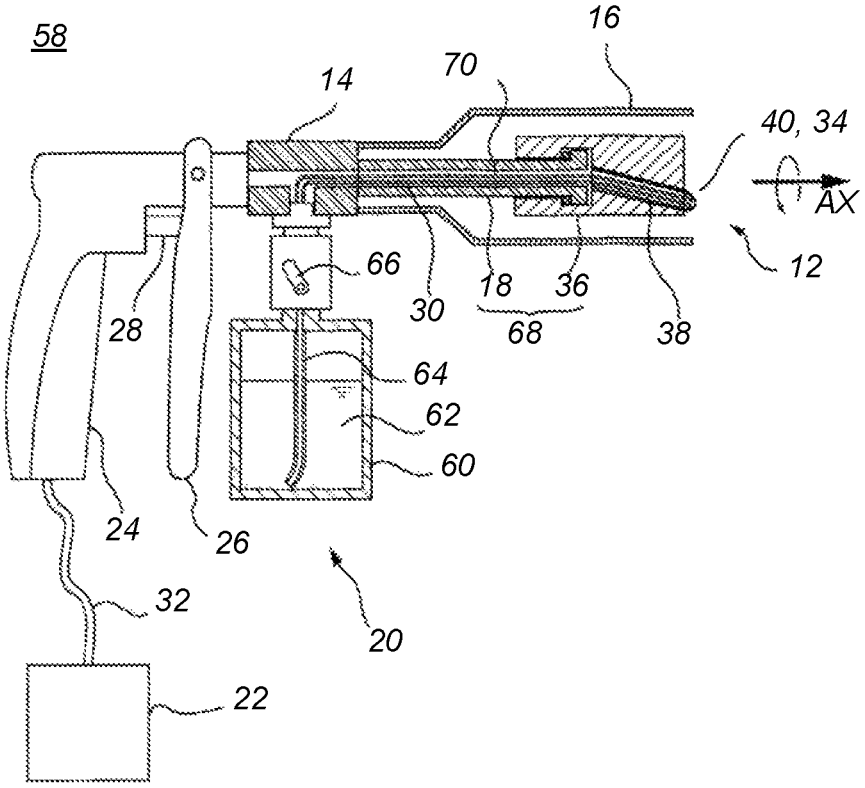
FIG. 6 depicts a partially cross sectional side view of an embodiment of a spray apparatus equipped with a spray nozzle and a medium container.
Figure 7A:
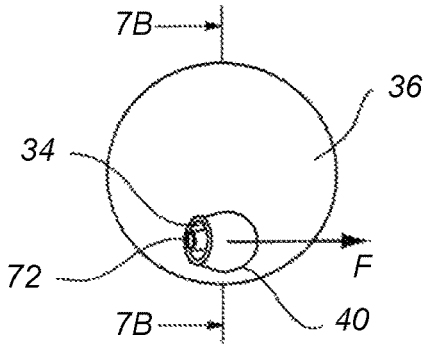
FIG. 7A depicts a perspective front view of an embodiment of the spray nozzle configured to deliver medium.
Figure 7B:
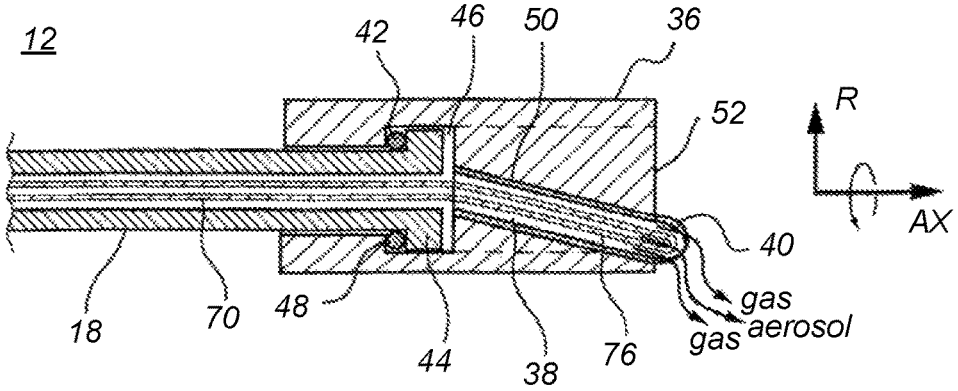
FIG. 7B depicts a side cross sectional view of the spray nozzle taken across line 7B-7B of FIG. 7A.
Figure 7C:
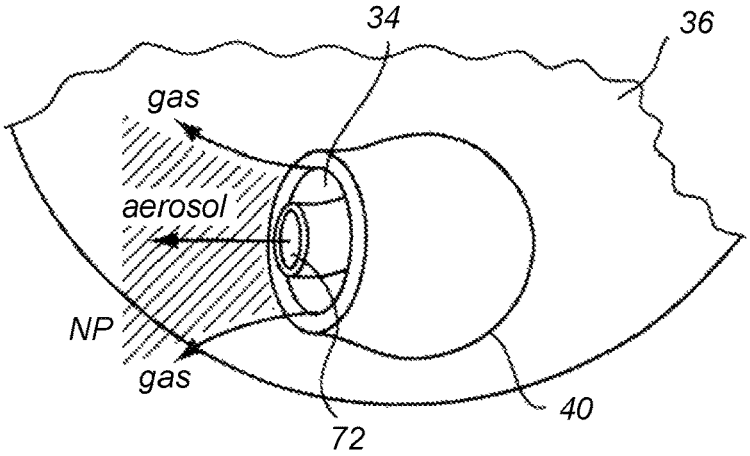
FIG. 7C depicts a partially magnified detailed view of FIG. 7A.

FIG. 6 is a partial sectional schematic view side view of an embodiment of spray apparatus 58 that includes spray nozzle 12 and medium container 60. FIG. 7A is a front view of an embodiment of spray nozzle 12 of spray apparatus 58. FIG. 7B depicts a cross section view taken across line 7B-7B of FIG. 7A. FIG. 7C is a partial expanded view of FIG. 7A.

As shown in FIG. 6, spray apparatus 58 includes, spray gun 20, spray nozzle 12, cover 16, medium container 60, guide (introduction) tube 64, and pressurized gas source 22 containing the pressurized gas (not shown). Medium 62 is contained in medium container 60 and includes detergent, granular materials such as blasting material, or powder or liquid paint or combinations thereof.

Spray apparatus 58 sprays a pressurized gas with force from the tip end of revolving rotating element 36 to form a negative pressure, and, thereby, draws medium 62 (for example, liquid and/or granular solids) from medium container 60. Medium 62 and pressurized gas is mixed and sprayed while rotating and diffusing. In some embodiments, medium 62 is used as a detergent, and it is formed into aerosol by the spraying pressure of the pressurized gas, and is blown against the cleaning surface to obtain a cleaning power, and thus spray apparatus 10 is used as a cleaning spray.

Spray gun 20 includes gun main body 24 having a passage for pressurized gas in its interior, joint 14, lever 26, and valve main body 28 communicating between the passage and the pressurized gas source 22 by means of the lever. Spray nozzle 12 is connected to the tip end of the joint 14. Horn-shaped cover 16 surrounds spray nozzle 12 and is useful for protecting the spray nozzle. Gun main body 24 and the pressurized gas source 22 are connected by way of a flexible tube 32.

During use, when the user holds lever 26, valve body 28 opens passage 30, and pressurized gas contained in the pressurized gas source 22 is sprayed from the tip end of spray nozzle 12 by way of joint 14. When the user releases lever 26, passage 30 from the pressurized gas source 22 to joint 14 is closed by the valve body 28, and the flow of the pressurized gas is stopped.

The pressurized gas is usually air compressed to a pressure of several to tens of units of MPa. Inert gases, such as nitrogen, carbon dioxide, or chlorofluorocarbons may be used. By opening the valve body 28, the pressurized gas is decompressed, and is blown out from the outlet port 34 of the spray nozzle 12 at spraying pressure higher than atmospheric pressure but less than about 1 MPa.

Medium 62 contained in the medium container 60 at atmospheric pressure is guided into spray nozzle 12 through guide tube 64, and is sprayed from the tip end of the nozzle. Guide tube 64 is provided with changeover valve 66 for opening and closing the passage 30 from medium container 60 to spray nozzle 12. The user manipulates changeover valve 66, and selects the operation mode, whether to spray the pressurized gas only from the tip end of the spray nozzle 12, or to mix with medium 62 to spray.

In some embodiments, spray nozzle 12 has an inner/outer double structure with an outer tube and an inner tube, and medium 62 is sprayed from the inner tube, and the pressurized gas is sprayed from between the outside of the inner tube and the inside of the outer tube.

Outer tube 68 is composed of fixed outer tube 18 fixed on spray gun 20, and rotating element 36 rotatably mounted on the tip end thereof. Rotating element 36 is made of a hard material, and passage 38 communicating with fixed outer tube 18 is provided in the inside, and a series of passage is formed together with the fixed outer tube. At nozzle tip 40, which corresponds to the tip end of rotating element 36, outlet port 34 is formed to open toward a direction crossing a direction of a rotary shaft (AX) and a radial direction (R), at a position offset from the rotary shaft of the rotating element in said radial direction.

Spray nozzle 12, when the base end of the fixed outer tube 18 and the joint 14 are connected, outer tube 18 is coupled to pressurized gas source 22 such that the opening operation of valve body 28 allows pressurized gas to be sprayed from the tip end of the passage. The pressurized gas exits nozzle end portion causing the rotating element to revolve about the rotating axis (AX) as described previously.

On the other hand, inner tube 70 may include a flexible tube, or in a way similar to the outer tube 68, it may be composed of fixed inner tube fixed on spray gun 20, and a rotating inner tube rotatably connected thereto.

As shown in FIG. 6, the base end side (left side in the diagram) of inner tube 70 is inserted into fixed outer tube 18, and tip end side (right side in the diagram) communicates with outlet port 34. The base end of inner tube 70 communicates with medium container 60. Opening 72 at the tip end side of inner tube 70 may be slightly projected from outlet port 34 as shown in FIGS. 7A and 7C, but may be disposed inside of passage 38 of rotating element 36, or may be fixed near the tip end of fixed outer tube 18. When the pressurized gas is sprayed from outlet port 34, a negative-pressure zone (NP) is formed not only around the outlet port, but also from the inside of passage 38 toward the tip end of fixed outer tube 18, so that medium 62 is drawn out from medium container 60 wherever opening end 72 may be disposed.

In some embodiments, the fixed inner tube for composing the base end side of the inner tube 70 is inserted into the fixed outer tube 18, and rotating inner tube 76 for composing tip end side is disposed inside passage 38. The opening end at the tip end side 72 of rotating inner tube 76 may be slightly projected from outlet port 34, or may be disposed inside passage 38. By connecting fixed inner tube 70 and rotating inner tube 76 rotatably, the rotating inner tube is rotatable, follows rotating element 36, and also communicates with medium container 60 by way of fixed inner tube 70. Therefore, by spraying the pressurized gas from outlet port 34, a negative-pressure zone (NP) is formed near the outlet port and inside passage 38, and medium 62 is drawn out from the fixed inner tube and the rotating inner tube, and it is mixed with the pressurized gas, and is sprayed from the outlet port.

Thus, by forming the tip end side of the passage for passing pressurized gas at high pressure by using a rotating element made of hard material, when spraying the pressurized gas, the nozzle end does not move unconstrained/unruly, or if spray apparatus 58 is used in low temperature environment, the nozzle is free from hardening or closing, and medium 62 may be sprayed stably.

Referring to FIG. 7B, the base end side (left side in the diagram) of inner tube 70 communicates with medium container 60 by way of changeover valve 66 (shown in FIG. 6). The middle portion of the inner tube is inserted into fixed outer tube 18. The tip end portion (inner tube tip end portion) 76 (right side in the diagram) is inserted into passage 38 provided inside of rotating element 36. As shown in FIG. 6, the base end of fixed outer tube 18 for forming the outer tube 68 communicates with the pressurized gas source 22 by way of joint 14.

Nozzle tip 40 positioned at the tip end (right side in the diagram) of passage 38 communicating with fixed outer tube 18 is formed at a position offset from the rotational axis (AX) of rotating element 36 in the radial (R) direction. Nozzle tip 40 is also provided with outlet port 34 opened in a direction intersecting with both rotational axis direction and the radial direction. In other words, the normal direction of the opening side of outlet port 34, that is, the spray direction has components of rotating direction about the rotational axis. In such a configuration, by manipulating lever 26, when the passage of the pressurized gas is opened, and the pressurized gas is sprayed from outlet port 34, as shown in FIG. 7A, nozzle tip 40 receives the spray reaction force F, and integrated rotating element 36 rotates about the rotational axis. Since outlet port 34 is directed in the intermediate direction between the rotational axis straightforward direction and the rotating direction about the rotational axis, when the pressurized gas is sprayed from the outlet port, rotating element 36 rotates in counterclockwise direction as seen from the rotational axis direction together with the outlet port, and the outlet port moves on the circumference of a circle with the radius corresponding to the offset width from the rotational axis of nozzle tip 40.

As shown in FIG. 7C, opening 72 at the tip end side of inner tube 70 is slightly projected from outlet port 34, and is disposed in a negative-pressure zone (NP), which is formed when the pressurized gas is sprayed from the outlet port. Therefore, by spraying the pressurized gas, the medium is drawn by the negative-pressure zone (NP) through passage 34, and flows out from opening end 72. The negative-pressure zone (NP) is formed, as shown in the diagram, not only near the outside of outlet port 34, but also in passage 38 (shown in FIG. 7B). Near the outside of outlet port 34, however, the pressurized gas is sprayed from the outlet port is expanded rapidly so that the pressure around there becomes low. Therefore, a strong drawing force is obtained for the medium. By such abrupt expansion of pressurized gas, the medium 62 (aerosol in FIG. 7C) flowing out from the opening end 72 is dispersed into fine substances that form an aerosol. Therefore, using detergent as the medium, the detergent aerosol may be blown to the surface to be cleaned together with the jet of the pressurized gas. The mixture of gaseous detergent (aerosol) and pressurized gas is sprayed by revolving rotating element 36, and is hence rotated and diffused, and the pressure wave of the pressurized gas is amplified, and the gas can be sprayed widely and uniformly on a broad surface to be cleaned at higher spraying pressure.

Referring to FIG. 6, fixed outer tube 18 is a tube body fixed and provided on spray gun 20. The connection mode of the base end of the fixed outer tube 18 and joint 14 is not particularly specified, but the fixed outer tube and joint should be mutually engaged by forming male threads on the outer circumference of the base end side of fixed outer tube 18 and forming corresponding female threads at the tip end side of the joint. The central line shape and the sectional shape of fixed outer tube 18 are not particularly specified. As shown, fixed outer tube 18, is circular in section and straight in the central line shape.

In some embodiments, the center in the section of fixed outer tube 18 and rotating axis (AX) of the rotating element 36 coincide with each other. However, as far as rotating element 36 is rotatable on fixed outer tube 18, and the sprayed pressurized gas does not leak out significantly from the gap between the fixed outer tube and rotating element 36, the rotational axis of the rotating element need not necessarily coincide with the center of the section of the fixed outer tube, and if the rotational axis is at an eccentric position from the center of the fixed outer tube, the extending direction of the tip end of the fixed outer tube may not coincide with the rotational axis.

Fixed outer tube 18 and rotating element 36, which form the passage of pressurized gas, are both made of hard materials, and spraying of pressurized gas does not deform these materials significantly. Specifically, hard plastic materials and metal materials may be used, and from the viewpoint of resistance to pressure and durability, fixed outer tube 18 is made of metal material, such as stainless steel etc., and from the viewpoint of smaller moment of inertia and smooth rotation, rotating element 36 may be made of hard plastic materials such as polyurethane etc., containing plasticizer added to them.

As shown in FIG. 7B, fixed outer tube 18 and rotating element 36 are connected by way of bearings 42 such as rolling bearing or sliding bearing. Flange 44 is formed at the tip end portion of fixed outer tube 18. Inside the base end side of rotating element 36, compartment 46 is provided for accommodating flange 44 and bearings 42. The base end side of chamber 46 has a thick portion 48 (e.g., projecting convex) so as to be smaller in diameter than flange 44 and larger in diameter than fixed outer tube 18. By inserting bearings 42 between flange 44 and thick portion 48, fixed outer tube 18 and rotating element 36 rotatably connected on the rotational axis in the center of the section of the fixed outer tube.

By burying pipe 50 in rotating element 36, passage 38 is formed. Pipe 50 rotating axially together with rotating element 36 coincides or nearly coincides with the rotational axis (AX) at the base end, and is opened to chamber 46, and thereby communicates with fixed outer tube 18. Tip end of pipe 50 is at an offset position as specified from the rotational axis, and is bent so that the direction of outlet port 34 at the opening end may have a rotating direction component with the specified rotating direction component, and, thereby, nozzle tip 40 is formed.

The material and shape of pipe 50 are not particularly specified, and, for example, a cylindrical tube of hard plastic material may be used. Pipe 50 may be a straight tube being crossed obliquely to the rotational axis as shown in the diagram, or being curved or bent in the central line shape.

Inner tube 70 of the passage of the medium is loaded only with a high atmospheric pressure of the reserve pressure of the medium container. Therefore, it is made, in some embodiments, of a soft material. In particular, in order that inner tube tip end portion 76 of inner tube 70 inserted in passage 38 of rotating element 36 may follow the rotating element and revolve smoothly, the inner tube is a flexible tube made of flexible synthetic resin, such as nylon, polytetrafluoroethylene, polyurethane, polypropylene or the like.

Inner tube 70 is protected by outer tube 68 formed of fixed outer tube 18 and rotating element 36. If a flexible tube is used in the inner tube, inner tube tip end 72 does not move unconstrained/unruly, and hence is not worn by colliding against cover 16.

Inner tube 70 may be formed as a series of flexible tubes from the base end to the tip end, or the portion inserted into the inside of fixed outer tube 18 may be formed as a fixed inner tube formed of hard plastic or metal, or a flexible tube may be fitted to the tip end so as to be revolving.

In some embodiments, the spray nozzle 12 may be manufactured in the following procedure. The tip end of a metal tube is expanded, and flange 44 is formed, and fixed outer tube 18 is manufactured. Rotating element 36, blanking the base end side in small diameter and the tip end side in large diameter, is manufactured by using a hard plastic material. The small diameter at the base end side of rotating element 36 coincides with the inside diameter of convex portion 48, and the large diameter of the tip end side coincides with the inside diameter of chamber 46 as indicated by broken line in FIG. 7B.

Fixed outer tube 18 mounted on the circumference of bearings 42 is inserted into rotating element 36 from the tip end side blanked in a larger diameter than the rotating element. The inside diameter of thick portion 48 of rotating element 36 is smaller than the diameter of flange 44 of fixed outer tube 18, and the flange acts as stopper, and the thick portion and the flange contact with each other by way of the bearings 42.

Inner tube 70 of a flexible tube having a smaller outside diameter than the inside diameter of fixed tube 18 is inserted into the fixed tube from the base end side or tip end side, and a part of the inner tube tip end portion 72 is projected from rotating element 36.

Pipe 50 is formed by bending so that the base end may be opposite to fixed outer tube 18 and that the tip end may come to the specified offset position from the rotational axis (AX), and is fixed temporarily from the tip end side of blanked rotating element 36, and the tip end portion of inner tube 70 is projected from outlet port 34 at the tip end side opening of pipe 50. At this time, temporarily fixed pipe 50 is directed so that outlet port 34 may be formed at a rotating direction portion from the desired rotational axis component.

By spraying fused resin material 52 on the periphery of temporarily fixed pipe 50, rotating element 36 is fixed, and by machining the tip end side of the rotating element, chamber 46 is formed inside of the rotating element. The base end side of chamber 46 is hermetically sealed by bearing 42. Resin material 52 sprayed to the base end side of rotating element 36 may be either same material or different material of the rotating element.

The tip end portion of inner tube 70 projecting from outlet port 34 is cut to a specified size of the projecting length. The projecting length is adjusted from the viewpoint of whether opening 72 of inner tube 70 is disposed or not within the negative-pressure zone (NP) formed at the time of spraying of pressurized gas from outlet port 34 and whether the medium is smoothly drawn or not.

Thus, fixed outer tube 18 and rotating element 36 are manufactured by using hard materials, and both are connected by bearings 42 to form outer tube 68, so that the components are not deformed by the spraying pressure of the pressurized gas, and the internal loss of spraying energy of pressurized gas is suppressed.

Rotating element 36 is formed in a columnar shape around the rotational axis, and nozzle tip 40 and outlet port 34 are formed in a shape settling within the plane of the tip end side end face, and the rotating element is free from any portion projecting in the radial direction, and spray apparatus 58 may be used safely.

In some embodiments, considering the safety of the user and others, as shown in FIG. 6, trumpet-like cover 16 is provided in the radial sideway direction of rotating element 36. Since cover 16 does not contact with rotating element 36, the inner surface is not contaminated, or the rotating element is not worn. Therefore, as far as not contacting with rotating element 36, the shape of cover 16 is not particularly specified, but to suppress excessive rotation and diffusion of the pressurized gas sprayed from revolving outlet port 34, the tip end of cover 16 may be projected from the outlet port like an awning to the tip end side. Cover 16 is attached to joint 14, for example, of the gun main body 24. Cover 16 may be detachable from gun main body 34.

In some embodiments, pipe 50 is buried in rotating element 36, and passage 38 is formed. In some embodiment, by piercing a hole in solid rotating element 36, passage 38 may be provided. Moreover, rotating element 36 having passage 38 in the inside is split into halves, and fixed outer tube 18 and bearings 48 are fitted into rotating element 36, and the halves of the rotating element may be joined and bonded integrally.

In some embodiments, pipe 50 may be exposed outside without being buried in the rotating element 36. That is, by offsetting the tip end in the radial (R) direction form the rotational axis (AX), pipe 50 formed to have a rotational direction component at least in the opening direction is composed of a hard material, and the pipe may be used as rotating element 36. When mounting rotating element 36 rotatably on the tip end of the fixed outer tube 18, both may be bonded directly to be slidable, for example, by mutually fitting without using bearing, or the both may be integrated by way of other rotational axis member not shown.

Figure 8A:
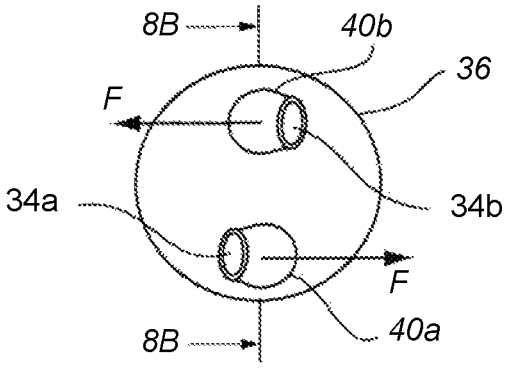
FIG. 8A depicts a perspective front view of an embodiment of a spray nozzle with a plurality of conduits.
Figure 8B:
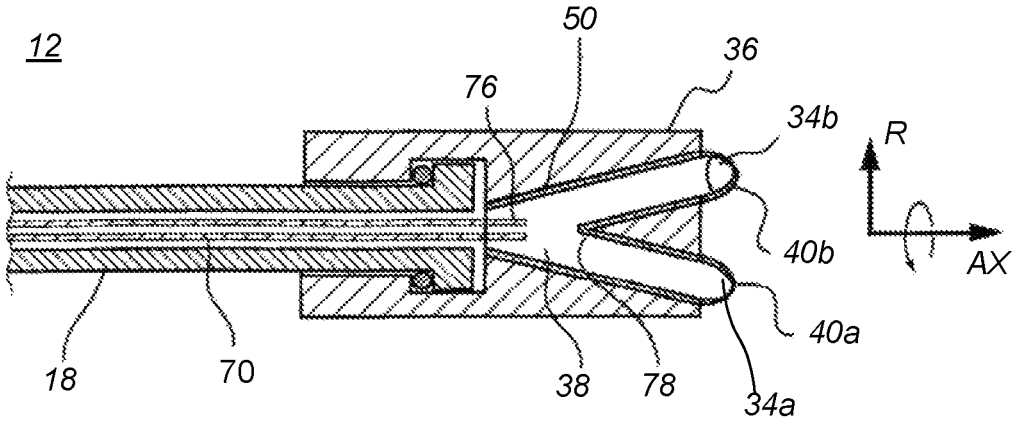
FIG. 8B depicts a side cross sectional view of the spray nozzle taken across line 8B-8B of FIG. 8A.

In some embodiments, spray nozzle 12 includes more than one outlet port. FIG. 8A is a perspective front view of spray nozzle 12 having at least two outlet ports. FIG. 8B depicts a cross-section taken across line 8B-8B in FIG. 8A. Pipe 50 buried in rotating element 36 is divided into two branches toward the tip end (right side in the diagram), and each tip end is bent and formed, and nozzle tips 40*a*, 40*b* are provided, and outlet ports 34*a*, 34*b* are opened and formed. Inner tube 70 is inserted into fixed outer tube 18 at its base end side, and the tip end side projects in the direction of the nozzle tip end from the fixed outer tube, and is inserted into passage 38. End 76 of inner tube 70, however, does not reach up to bifurcate portion 78, and inner tube 70 and pipe 50 do not interfere with each other if the pipe rotates around the rotational axis (AX) together with rotating element 36.

Inner tube 70 communicates with the medium container 60 at the base end side, and a passage of medium is formed. Inner tube 70 may be inserted and fixed in fixed outer tube 18, and its material is not particularly specified as far as corrosion or abrasion may not take place inside due to circulation of the medium, and hard plastics and metals may be used favorably.

During use, pressurized gas flows toward the tip end of spray nozzle 12 between inner tube 70 and fixed outer tube 18 and branches into two directions through bifurcate pipe 50, and sprays from the outlet ports 34*a*, 34*b*. During use, a negative-pressure zone is formed near the outside of outlet ports 34*a*, 34*b* and inside passage 38. Inner tube tip end portion 76 is disposed in the negative-pressure zone. Therefore, the medium is drawn out from inner tube 70, and is mixed with the pressurized gas in passage 38, and is rotatory-sprayed from spray ports 34*a*, 34*b*.

Inner tube tip end portion 76 of fixed inner tube 70 is inserted inside passage 38, or may be disposed at a position flush with the tip end of fixed outer tube 18 or inside of the fixed outer tube as far as the medium can be drawn out from inner tube 70 by the suction effect in the negative-pressure zone. Since, however, the negative-pressure zone is at the lowest pressure near the exist of outlet ports 34*a*, 34*b*, inner tube tip end 76 is disposed close to outlet ports 34*a*, 34*a*, and inside of passage 38 and behind and near bifurcate portion 78.

As shown in FIG. 8B, the lower half and upper half of rotating element 36 are formed symmetrically about the center of rotational axis (AX). Therefore, nozzle tips 40*a*, 40*b*, outlet ports 34*a*, 34*b* are disposed symmetrically about the rotational axis. Lower outlet port 34*a* has an opening component in rotation reverse direction (left direction in the diagram) of the direction intersecting with the offset direction (lower direction in (b)) from the rotational axis of the rotational axis direction (front direction on sheet of paper in (b)). Due to necessity of spraying the medium in the rotational axis direction, outlet port 34*a* has an opening portion in the rotational axis direction. Therefore, outlet port 34*b* is opened in the intermediate direction between the rotational axis direction and the rotation reverse direction. Similarly, upper outlet port 34*b* is opened toward the rotational axis direction and the intermediate direction toward the rotation reverse direction (right direction in (b)). In other words, outlet ports 34*a*, 34*b* are opened and formed at the tip end of rotating element 36 having a same rotating direction component about the rotational axis.

Hence, when the pressurized gas (supplied through passage 38 inside fixed outer tube 18) is sprayed from outlet ports 34*a*, 34*b*, the reaction force F applied to rotating element 36 is the common rotating direction as seen from the arrow in diagram (b), specifically counterclockwise direction as seen from the rotational axis direction.

Thus, a plurality of outlet ports 34*a*, 34*b* are disposed at symmetrical positions around the rotational axis, and directed in the same rotating direction. During use, rotation of rotating element 36 is not eccentric in the radial direction with respect to fixed outer tube 18 or does not swing or oscillate, and thereby rotates favorable around the rotational axis. By forming openings 34*a*, 34*b* of the inner tube, the medium is dispersed and sprayed more uniformly.

In some embodiments, facing of the plurality of spray ports in a same rotating direction means that the pressurized gas sprayed from any spray port does not interfere with the pressurized gas sprayed from other spray port to cancel the reaction forces acting on rotating element 36, but does not mean complete coincidence of the opening directions. The same holds true with the symmetrical positions of the plurality of spray ports around the rotational axis, and it is enough if the plurality of spray ports are disposed in good balance around the rotational axis.

As shown, pipe 50 is branched, and the plurality of outlet ports 34*a*, 34*b* are disposed at the tip ends, but, it is envisioned that a plurality of tubes 50 each having one spray port may be connected directly to the tip end of one or a plurality of fixed outer tubes 18, or disposed indirectly or rotatably by way of other connection member. In some embodiments, a plurality of independent passages 38 may be machined inside the solid rotating element, and outlet ports 34*a*, 34*b* may be formed at each tip end in the opening direction.

Figure 9A:
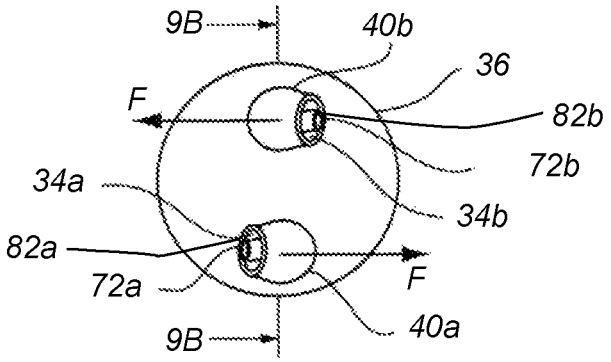
FIG. 9A depicts a perspective front view of an embodiment of another spray nozzle with a plurality of outlets.
Figure 9B:
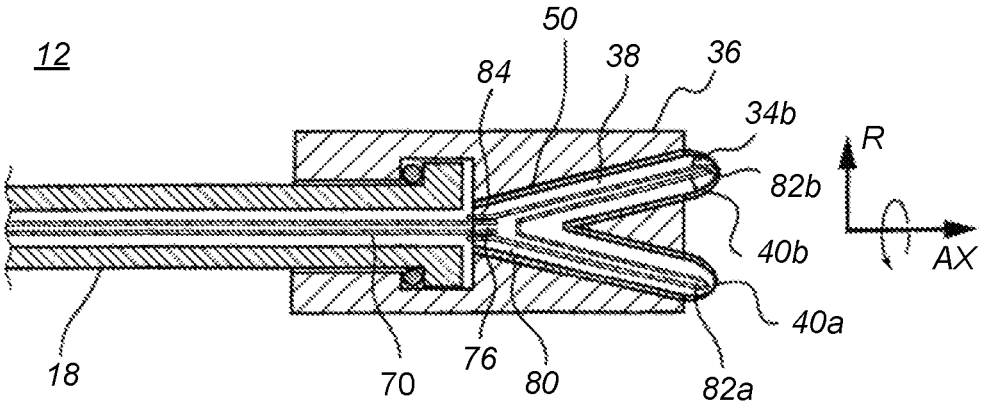
FIG. 9B depicts a side cross sectional view of the spray nozzle taken across line 9B-9B of FIG. 9A

In some embodiments, spray nozzle 12 may include a plurality of passages for dispersal of medium from the spray nozzle. FIG. 9A depicts a perspective view of an embodiment of a tip end portion of spray nozzle 12. FIG. 9B corresponds to a cross-section taken across line 9B-9B of FIG. 9A. Pipe 50, divided into two sections, is buried in rotating element 36, and passages 38 are formed. In contrast to FIGS. 8A and 8B, bifurcate rotating inner tube 80 is inserted and fixed in the passages 38, and is rotatably connected to inner tube 70.

Rotating inner tube 80 has base end 84 rotatably fitted to inner tube tip end portion 76 of fixed inner tube 70. Tip ends 82*a*, 82*b* of bifurcate rotating inner tube 80 are inserted into bifurcate passages 38 respectively.

The position of tip ends 82*a*, 82*b* may be either inside of passages 38, or outside of the nozzle tip end side projected from outlet ports 34*a*, 34*b*. As shown in FIG. 9A, tip ends 82*a*, 82*b* project respectively from outlet ports 34*a*, 34*b* of rotating element 36, and opening 34*a* of tip end 84*a* and opening 34*b* of tip end 84*b* are disposed in the negative-pressure zone formed near the outside of outlet ports 34*a*, 34*b*.

Rotating inner tube 80 is made of hard plastics, metals, or other hard materials, and is connected to inner tube tip end portion 76 to keep communication with inner tube 70, and rotates about the rotational axis (AX) by following up rotation of the rotating element 36 due to spraying of pressurized gas. In this state, when the pressurized gas is sprayed from outlet ports 34*a*, 34*b*, a negative pressure is formed near opening ends 34*a*, 34*b* of rotating inner tube 80, and the medium 62 is drawn in through rotating inner tube 80 and inner tube 70, and, then is mixed with the pressurized gas, rotated and sprayed.

Base end 84 of the rotating inner tube 80 and the inner tube tip end portion 76 may be connected air-tightly. In some embodiments, forming base end 84 in a wider diameter and covering and fitting inner tube tip end portion 76, the medium will not escape the inner tube tip end portion to leak out to passages 38.

Rotating inner tube 80 is configured so that base end 84 may slide and rotate about inner tube tip end portion 76 of inner tube 70 as the rotational axis. Alternatively, a core member as rotational axis of rotating inner tube 80 may be provided by projecting from inner tube 70 to the tip end side, and the rotating inner tube may be mounted on such core member.

Figure 10A:
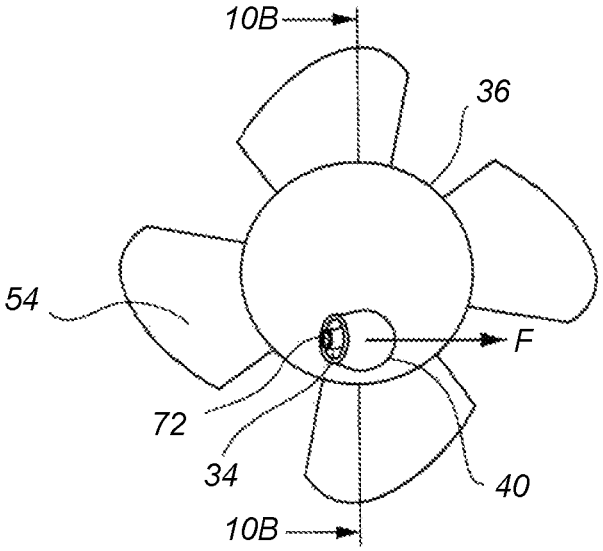
FIG. 10A depicts a perspective front view of an embodiment of a spray nozzle with a fan.
Figure 10B:
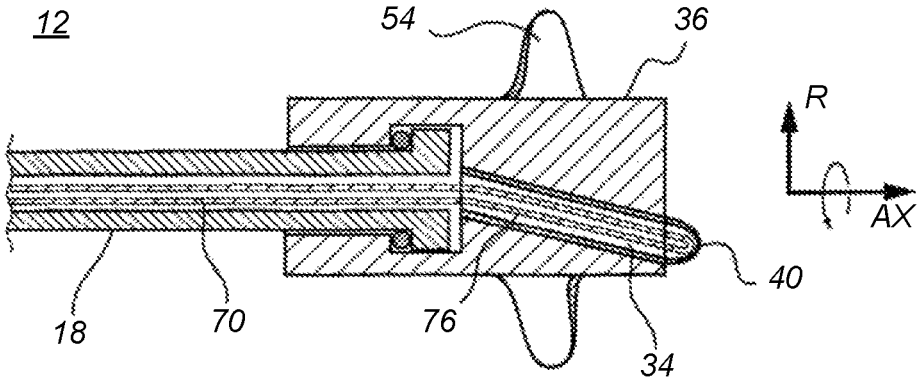
FIG. 10B depicts a side cross sectional view of the spray nozzle taken across line 10B-10B of FIG. 10A.

In some embodiments, spray nozzle 12 that dispenses medium includes a fan. FIG. 10A depicts an end view of an embodiment of the spray nozzle including a fan. FIG. 10B corresponds to a cross-section taken across line 10B-10B of FIG. 10A. Rotating element 36 is provided with an axial flow fan (fan) 54 on its circumference, and when the rotating element is rotated by spray of pressurized gas, the fan generates an air stream toward the direction of rotational axis (AX). Accordingly, if the pressurized gas spray from the outlet port 34 is excessive in the radial (R) direction, and insufficient in the rotational axis (AX) direction, an axial flow is generated by fan 54, and by its reaction force, the rotation of rotating element 36 is suppressed, and together with the axial flow, a sufficient spraying force is obtained in the direction of rotational axis. That is, by suppressing excessive rotation of rotating element 36 by fan 54, diffusion of pressurized gas and medium is suppressed, and the spraying force in the direction of rotational axis is enhanced. Therefore, by only providing with rotation resisting means for suppressing the rotation of rotating element 36, the spraying force in the direction of rotational axis may be adjusted, and moreover by providing the rotating element with the axial flow fan as in the preferred embodiment, the rotation resistance occurring in the rotating element is not spent as a mere energy loss, but is converted into a jet flow in the direction of rotational axis, thereby assisting the spraying force of the pressurized gas. In some embodiments, fan 54 may be detachably installed in rotating element 36. As a result, depending on the application of spray apparatus 58, the spraying force in the direction of rotational axis may be increased or decreased as desired. From the same viewpoint, moreover, the deflection angle of fan 54 or the mounting angle on rotating element 36 may be variable and adjustable.

Figure 11A:
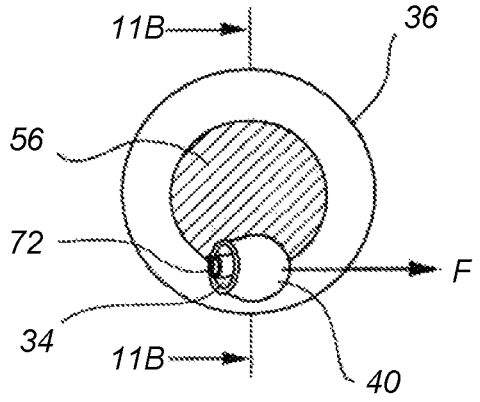
FIG. 11A depicts a perspective front view of an embodiment of the spray nozzle with a brush.
Figure 11B:
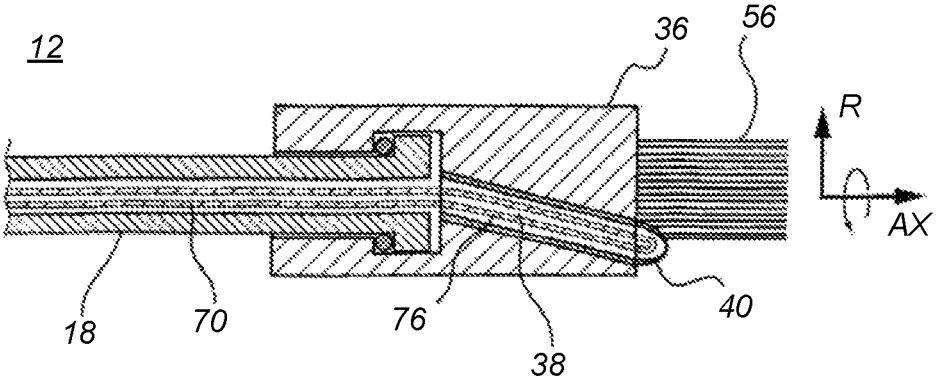
FIG. 11B depicts a side cross sectional view of the spray nozzle of FIG. 11A taken across line 11B-11B.

In some embodiments, spray nozzle 12 that dispenses medium includes a brush. FIG. 11A depicts a perspective end view of a tip end of a spray nozzle with a brush. FIG. 11B corresponds to a cross-section taken across line 11B-11B of FIG. 11A. Rotating element 36 is provided with brush 56 projecting from its tip end. Therefore, when rotating element 36 is rotated by the spray reaction force F of the pressurized gas, brush 56 also rotates about the rotational axis, and the surface to be sprayed can be physically wiped in the rotating direction by using the brush. Brush 56 is also bent in the radial direction by expansion and rotating diffusion of pressurized gas sprayed from rotating outlet port 34, and the surface to be sprayed is wiped by the brush in both rotating direction and radial direction.

Therefore, when spray apparatus 58 is used as a cleaning spray, by using spray nozzle 12, the aerosol of the detergent may be sprayed to the surface to be sprayed, and the sticking dirt is physically wiped off by brush 56 in longitudinal and lateral directions, and is removed.

Brush 56 may be attached to rotating element 36 in various modes. As shown in the drawing, by installing at the central side of rotational axis (AX) from outlet port 34, pressurized gas sprayed from the outlet port is prevented from flowing into the rotational axis side (central direction), and the detergent may be sprayed to the object to be sprayed (the dirt) disposed on the extension of rotational axis by enclosing uniformly from all directions. To the contrary, by installing brush 56 at the outer side from outlet port 34, the pressurized gas sprayed from the outlet port is guided to the axial center side, and the detergent is concentrated on the object of spray. Brush 56 may be planted on the tip end side of rotating element 36, or may be provided on the circumference of the rotating element, and the tip end of brush 56 may be projected from outlet port 34. In some embodiments, brush 56 is attached to cover 16

Examples of the combinations of the spray nozzle are described herein. A spray nozzle for ejecting and dispersing a jet of pressurized fluid stored in a pressurized fluid supply source from an outlet which is rotating, includes: a stationary tube communicated at the proximal end to the pressurized fluid supply source; and a rotary member made of a rigid material, having an air passage provided therein for communicating with the stationary tube, and arranged rotatably in relation to the distal end of the stationary tube, wherein the outlet is provided at a location, which is offset distanced along a radial direction from the axis of rotation of the rotary member, in the distal end of the rotary member and its opening is contemplated to face a direction which intersects both the axis of rotation and the radial direction.

In some embodiments, the spray nozzle includes a stationary tube and a rotary member joined to each other by a bearing.

In some embodiments, the spray nozzle includes a stationary tube communicated at the proximal end to the pressurized fluid supply source; and a rotary member made of a rigid material, having an air passage provided therein for communicating with the stationary tube, and arranged rotatably in relation to the distal end of the stationary tube, wherein the outlet is provided at a location, which is offset distanced along a radial direction from the axis of rotation of the rotary member, in the distal end of the rotary member and its opening is contemplated to face a direction which intersects both the axis of rotation and the radial direction. The rotary member has two or more outlets provided therein for communicating respectively with the stationary tube and located symmetry with respect to the axis of rotation while the outlets are opened in the direction of rotation about the axis of rotation. The stationary tube and a rotary member are joined to each other by a bearing.

In some embodiments, the spray apparatus may include: (A) a pressurized fluid supply source where pressurized fluid is stored; (B) a spray nozzle including a stationary tube communicated at the proximal end to the pressurized fluid supply source, and a rotary member made of a rigid material, having an air passage provided therein for communicating with the stationary tube, and arranged rotatably in relation to the distal end of the stationary tube, wherein the outlet is provided at a location, which is offset distanced along a radial direction from the axis of rotation of the rotary member, in the distal end of the rotary member and its opening is contemplated to face a direction which intersects both the axis of rotation and the radial direction; and (C) a valve for closing and opening the passage of the pressurized fluid between the pressurized fluid supply source and the stationary tube, wherein the rotary member is turned about the axis of rotation by the ejection of the pressurized fluid so that the pressured air ejected from the outlet can be dispersed.

In some embodiments, the spray nozzle may include a spray nozzle which is a nozzle having an inner/outer double structure, with an outer tube and an inner tube inserted into this outer tube, for spraying pressurized gas stored in a pressurized gas supply source from between said inner tube and said outer tube and spraying a medium from said inner tube, the medium including liquid, granular solids, or a mixture of the liquid and the granular solids and stored in a supply source of the medium, the spray nozzle having all of characteristics of (a) to (c) as follows: (a) the outer tube has (i) a fixed outer tube, with a base end communicated with the pressurized gas supply source, and has (ii) a rotating element made of a hard material, having a through hole inside so as to be communicated with the fixed outer tube, and rotatably fitted to the tip end of the fixed outer tube, and (iii) on the tip end of the rotating element, spray ports are formed so as to be opened toward a direction crossing a direction of a rotary shaft and a direction of a diameter, at a position offset from the rotary shaft of the rotating element in the diameter direction; (b) the inner tube has flexibility, with the base end side communicated with the supply source of the medium, and the tip end side communicated with the spray ports; and (c) by spraying the pressurized gas from the spray ports, the rotating element rotates around the rotary shaft by the spray reaction force, and the medium is drawn from the supply source of the medium through the inner tube, by a negative pressure generated in the vicinity of the spray ports or inside of the through hole, and the drawn medium is mixed with the sprayed pressurized gas and is sprayed from the spray ports.

In some embodiments, the spray nozzle may include a nozzle having an inner/outer double structure, with an outer tube and an inner tube inserted into this outer tube, for spraying pressurized gas stored in a pressurized gas supply source from between the inner tube and the outer tube and for spraying a medium from the inner tube, the medium includes liquid, granular solids, or a mixture of the liquid and the granular solids and stored in a supply source of the medium, the spray nozzle having all of characteristics of (a) to (c) as follows: (a) the outer tube has (i) a fixed outer tube, with a base end communicated with the pressurized gas supply source, and has (ii) a rotating element made of a hard material, having a through hole inside so as to be communicated with the fixed outer tube, and rotatably fitted to the tip end of the fixed outer tube, and (iii) on the tip end of the rotating element, spray ports are formed so as to be opened toward a direction crossing a direction of a rotary shaft and a direction of a diameter, at a position offset from the rotary shaft of the rotating element in the diameter direction; (b) the inner tube has (i) a fixed inner tube inserted into the fixed outer tube, with the base end communicated with the supply source of the medium, and has (ii) a rotary inner tube made of a hard material, with the base end rotatably connected to the tip end of the fixed inner tube inside of the fixed outer tube or inside of the through hole, and the tip end side inserted into the through hole; and (c) by spraying the pressurized gas from the spray ports, the rotating element and the rotary inner tube are rotated around the rotary shaft by this spray reaction force, and by a negative pressure generated in the vicinity of the spray ports or inside of the through hole, the medium is drawn from the supply source of the medium through the inner tube, and the drawn medium is mixed with the sprayed pressurized gas and sprayed from the spray ports;

In some embodiments, the spray nozzle may include a plurality of spray ports communicated with the tip end of the fixed outer tube respectively in a rotational symmetry position with respect to the rotary shaft, and the plurality of spray ports are formed toward the same rotational direction around the rotary shaft.

In some embodiments, the spray nozzle described herein may include an opening end of the inner tube at the tip end side disposed in a negative-pressure zone formed by spray of said pressurized gas, in the vicinity of the spray ports. In some embodiments, the spray nozzle described herein includes an opening end of the inner tube at the tip end side disposed inside of said through hole;

In some embodiments, the spray nozzle described herein includes a fixed outer tube and the rotating element connected to each other via a bearing.

In some embodiments, the spray nozzle described herein includes a fan coupled to the rotating element, the fan for generating an axial flow in the direction of the rotary shaft by rotation of this rotating element;

In some embodiments, the spray nozzle described herein includes a brush coupled to the rotating element or cover.

Figure 12:
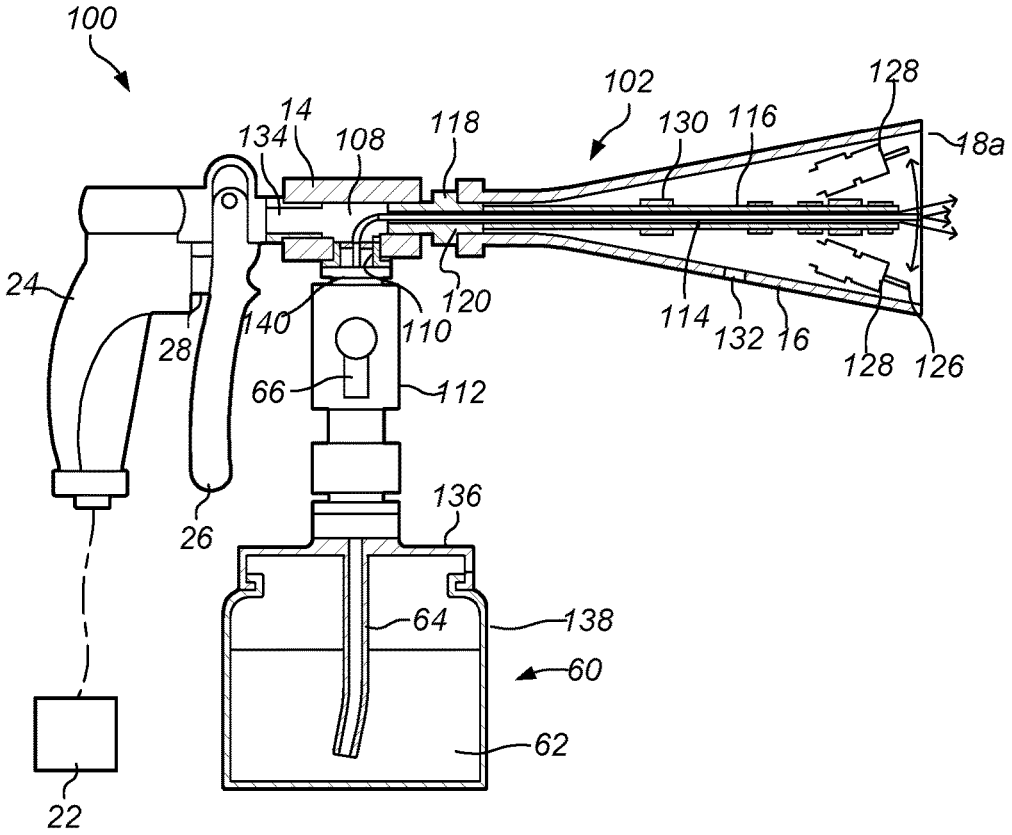
FIG. 12 depicts a side cross-sectional view of an embodiment of a spray nozzle having a flexible conduit.
Figure 13:
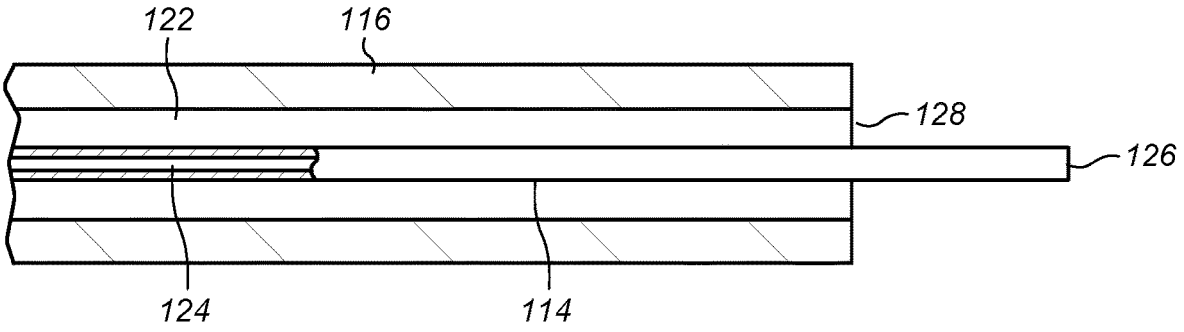
FIG. 13 depicts a side cross-sectional view of the flexible conduit of the spray nozzle depicted in FIG. 12.
Figure 14A:
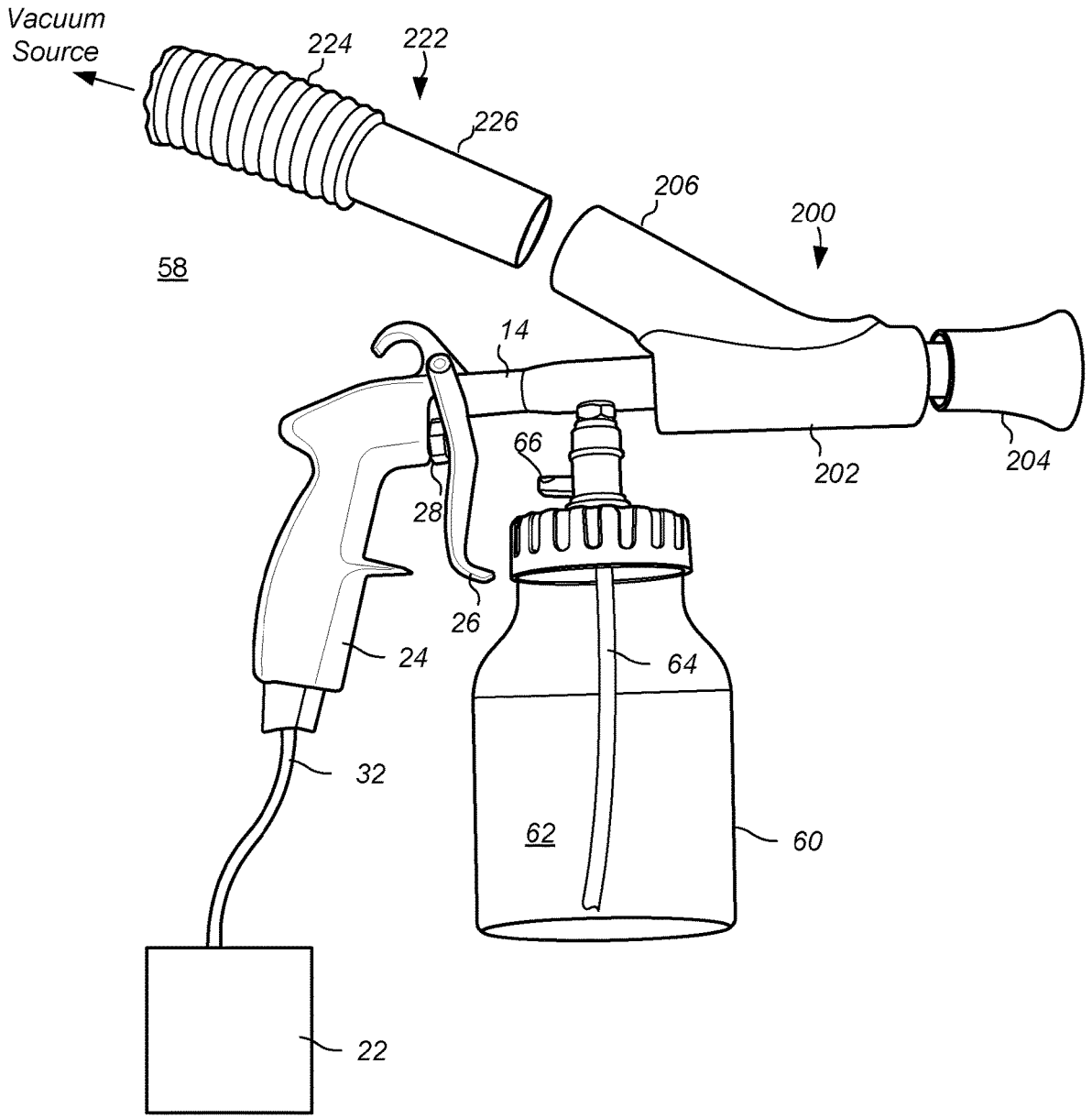
FIG. 14A depicts a perspective exploded side view of an embodiment of a spray apparatus with spray nozzle, a vacuum port, and a medium container.
Figure 14B:
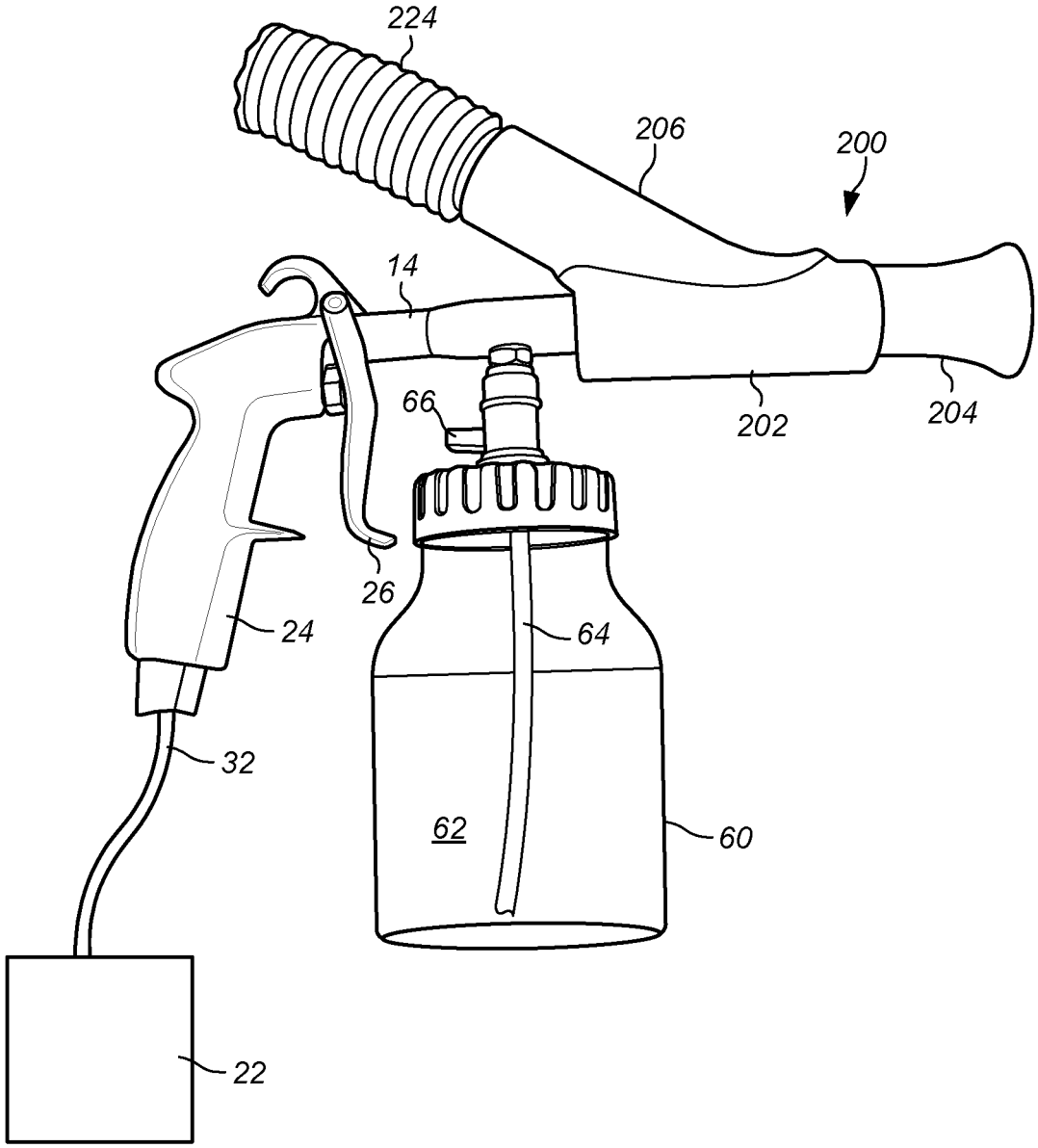
FIG. 14B depicts a perspective side view of an embodiment of the spray apparatus having a rigid conduit assembled.

In some embodiments, the spray apparatus includes a flexible conduit. The use of a flexible conduit may allow for a different aerosol spray pattern than a rigid conduit. FIGS. 12 and 13 depict embodiments of a spray apparatus with a flexible conduit. FIG. 12 depicts a side view of a spray apparatus containing a spray nozzle having a flexible conduit. FIG. 13 depicts a side view of the flexible conduit of the spray nozzle.

Spray apparatus 100 may include a pressurized gas supply source 22, medium supply source 60, nozzle 102 coupled to a gun shaped body 24 by, for example, joint 14 and cover 16. Joint 14 may include first opening 108 configured to allow a gas to pass from pressurized gas supply source 22 to the nozzle 102. Joint 14 may also include a second opening 110 communicating with first opening 108. Fluid supply source 60 may be coupled to second opening 110 by means of valve 112.

Nozzle 102 includes an inner conduit 114 disposed within an outer conduit 116. An installation member 118 is coupled to a front end of joint 14. Installation member 118 includes an opening 120 configured to receive inner conduit 114. A base end of outer nozzle 16 may be fixed to a front end of installation member 118.

Inner conduit 114 may be positioned within outer conduit 116 such that a gas flow path 122 is formed between an inner-surface of the outer conduit 116 and an outer-surface of the inner conduit 114. Gas flow path 122 communicates with the first opening 108 of joint 14 through opening 120 of installation member 118. A rear portion of inner conduit 114 extends through opening 120 and into first opening 108. The rear portion further extends into second opening 110, and is thus coupled to connector 112. Inner conduit includes passage 124 through which a fluid is passed during use.

Outer conduit 116 may be composed of a flexible polymeric material. Examples of flexible polymeric materials include, but are not limited to, nylon, polytetrafluoroethylenes (e.g., Teflon), polyurethane, and polypropylene. Inner conduit 114 may also be composed of a flexible polymeric material. Inner conduit 114 may be composed of the same material as outer conduit 116. In some embodiments, only the portion of the inner conduit that is disposed within outer conduit 114 may be formed from a polymeric flexible material.

Gas passing through gas flow path 122 between the outer conduit 116 and the inner conduit 114 is ejected from an end of outer conduit 116. As the gas is ejected, the portion of outer conduit 116 and inner conduit 114 extending from the base end of the outer conduit moves with respect to the body 24 as shown by the arrows in FIG. 12. Movement of the inner and outer conduits may be in a gyrating or reciprocating movement due to the flexibility of the conduits.

End 126 of inner conduit 114 extends beyond end 126 of outer conduit 116. As gas is ejected from outer conduit 116, a negative pressure area is formed outside end 128. End 126 of inner conduit 114 is positioned within the negative pressure region generated by the passage of gas through outer conduit 116.

One or more balancing members 130 may be coupled to an outer surface of outer conduit 116. Balancing members 130 may be formed of a polymeric material. When multiple balancing members are used they may be positioned at spaced intervals along outer conduit 116. Balancing members 130 control the inertial power of the nozzle as it moves within cover 16.

Cover 16 may be coupled to the installation member 118 (similar to joint 14 in FIGS. 1 and 6). Cover 16 may be configured to restrict movement of conduit 116. As shown, cover 16 is conical (horn) shaped. Cover 16 may be formed from a polymeric material or metal. A front opening of cover 16 may project past end 126 of inner conduit 114 and end 128 of outer conduit 116. As conduit 116 and thus conduit 114 move, the movement of the conduits may be restricted by contact of the conduits with an inner surface of cover 16. Thus, movement of the conduits may be restricted to a predetermined area. Vent 132 may be formed in a portion of cover 16. Vent 132 may allow gas to escape cover 16, if outlet of the cover is pressed against a surface.

Pressurized gas supply source 22 may be coupled to body 24 via conduit 134. Valve 28 allows communication between flow passage 122 and pressurized gas source 22. In use, valve 28 opens flow passage 122 when lever 26 is pulled by the hand of an operator. Opening of valve 28 allows flow pressurized fluid stored in pressurized gas source 22 through flow passage 122 and to be ejected from the distal end of spray nozzle 102. When lever 26 is returned back to its original position by user, valve 28 closes flow passage 122 to stop the flow of the pressurized fluid.

Medium supply source 60 is removably coupled to connector 112. Guide tube 64 is coupled to a base portion of inner nozzle 114 through valve 112. Guide tube 64 extends into medium supply source 60. Medium supply source 60 may include a cover 136 coupled to body portion of medium supply source 60. Medium supply source 60 may be removably coupled to valve 112 using a suitable coupling mechanism (e.g., a screw mechanism).

During use medium supply source 60 may be coupled onto connector 112 of a fluid spraying apparatus. Changeover valve 66 in connector 112 is set in an open position to allow a fluid connection between guide tube 64 and inner conduit 114.

In some embodiments, the pressurized gas supply source 22 may be a compressor. If a compressor is used, the compressor may be activated to generate compressed air. Alternatively, pressurized gas supply source 22 may be a tank of pre-compressed air. Lever 26 activated to allow compressed air to flow through gas flow path 122 of outer conduit 116 via conduit 134, first opening 108, and opening 120 from the pressurized gas supply source 22. This combination of conduits and openings constitute a primary communication path. Pressurized gas that flows along the primary communication path is forcefully ejected from outer conduit 116 through end 128. As gas is ejected, outer conduit 116 and inner conduit 114 will begin to move. The back portion of the inner and outer conduits are fixed, while the front portions of the inner and outer conduits are free to move. The front portions of the inner and outer conduits are formed from a flexible material. The movement of the inner and outer conduits may be limited to a predetermined area by cover 16, which surrounds at least a portion of outer conduit 116. Thus, the front portion of the conduit 116 moves within cover 116. Balancers 130 may be coupled to an outer surface of conduit 116 to stabilize movement of the conduit.

When gas is ejected from outer nozzle 116, an area of negative pressure acts on end 126 of the inner conduit 114. Medium 62 may be pulled into the ejected gas stream through inner conduit 114 and guide tube 64 by the negative pressure area. The route by which the medium flows through constitutes the second communication path.

The produced combination of fluid and gas is ejected away from outer conduit 116. Simultaneous with the ejection of the fluid gas mixture, spray nozzle 102 may be moving. In some embodiments, conduits 114 and 116 of spray nozzle 102 may be rotating in a substantially circular pattern to produce a circular spray of the fluid. The ejected fluid contacts the surface providing the desired cleaning or polishing effect.

The movement of conduits 114 and 116 may be limited by cover 16 to a predetermined area. In some embodiments, movement of the nozzle 6 may be in a circular pattern. Movement of the conduits in a circular pattern may provide additional force to the ejected mixture of gas and fluid. Therefore, ejected mixture of gas and fluid may have an increased power with respect to flow from a fixed nozzle.

The use of a single conduit 134 coupled to body 24 may improve the reliability of the fluid spraying device. Additionally, the positioning of medium supply source 60 between body 24 and nozzle 102 improves the balance of the device. When necessary, changing or replenishing the fluid may be accomplished by replacing medium supply source 60 with a new medium supply source or by refilling the depleted the medium supply source.

The fluid may be inhibited from flowing through nozzle 102 by operation of changeover valve 66. When the changeover valve 66 is set in a closed position and the lever 26 is activated, as described above, gas from pressurized gas supply source 22 passes through the primary communication path and is ejected from spray nozzle 102. Thus, medium from medium supply source 60, may be inhibited from entering inner conduit 114. In this manner a stream of pressurized gas may be directed to the surface. The stream of ejected gas may be used to blow and remove dust and dirt from the surface. A gas stream may also be used to dry a surface after, for example, a cleaning or painting operation.

In some embodiments, connector 112 is removed spray apparatus 100 and a cap is attached to coupling member 140. Placing a coupling member on connector 112 allows the spray apparatus to be used without medium supply source. Removal of medium supply source may allow spray apparatus 100 to be used in spaces where the medium supply source will not fit. In some embodiments, spray apparatus 100 is manufactured without inner conduit 114, connector 112 and medium supply source 60. In such an embodiments, joint 14 does not include opening 110.

In some embodiments, cover 16 includes a brush as previously described herein. The mixture of gas and fluid that is ejected from nozzle 102 may spray out along the internal circumference surface of cover 16. Bristles of the brush may be bent over the ejected mixture of gas and fluid contacts the flow of the mixture of gas and fluid is discontinued. In this manner, the bristles may move into a distorted position according to the movement of the ejected mixture of gas and fluid. When the brush touches the surface to be washed, the surface may be washed by the bristles in a pattern corresponding to the pattern of movement of the nozzle.

In some embodiments, the spray nozzle apparatus described herein includes a pressurized gas supply source in which pressurized gas is stored; a medium supply source in which liquid, granular solids or a mixture of the liquid and the granular solids is stored; and a valve element for shutting off or releasing the pressurized gas flown to the outer tube from the pressurized gas supply source, where the pressurized gas and the medium are sprayed in a mixed state.

In some embodiments, the spray nozzle apparatus is portable and light weight. For example, the spray nozzle apparatus may weighs less than 10 pounds or less than 5 pounds. A light weight and compact spray nozzle apparatus allows efficient cleaning of vehicle interiors and/or small spaces.

In some embodiments, the spray apparatus is capable of applying vacuum to a material. By applying vacuum to a material, particles embedded in the material and/or loosened during treatment of the material with the spray nozzle described herein may be removed from the material. For example, when using the spray apparatus to remove particles from a material using an aerosol of air or an aerosol of air and medium, particles may be removed from the material. Some of the particles, however, may remain on the surface of the material and/or slightly below the surface of the material. Applying vacuum to the material removes all or a substantial portion of the remaining particles. In some embodiments, applying vacuum to the material prior to applying the aerosol may assist in cleaning the material. Vacuum may be applied on material that is wet. For example, wet from cleaning with medium solution.

Figure 15:
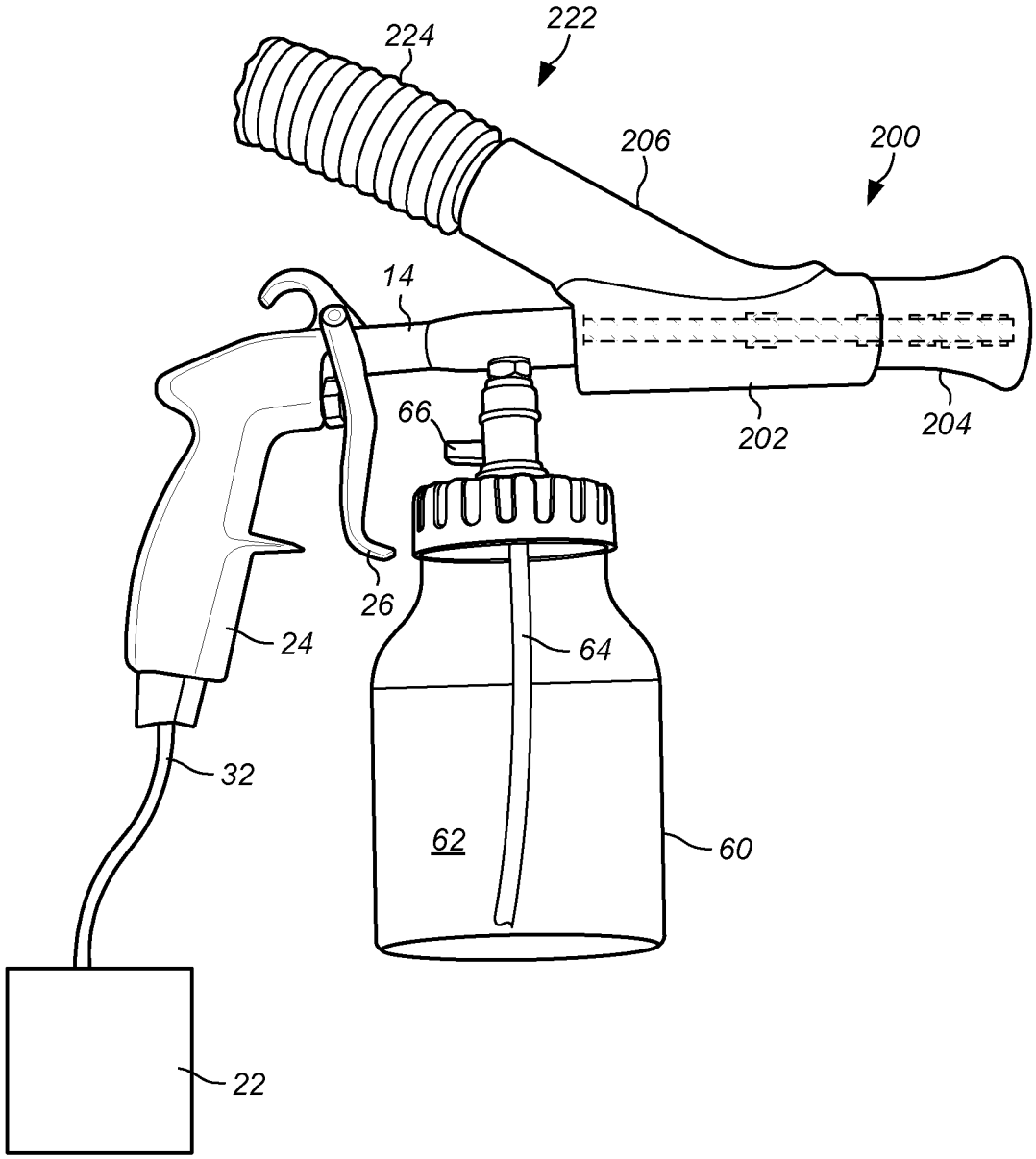
FIG. 15 depicts a perspective side view of an embodiment of the spray apparatus having a flexible conduit assembled.
Figure 16:
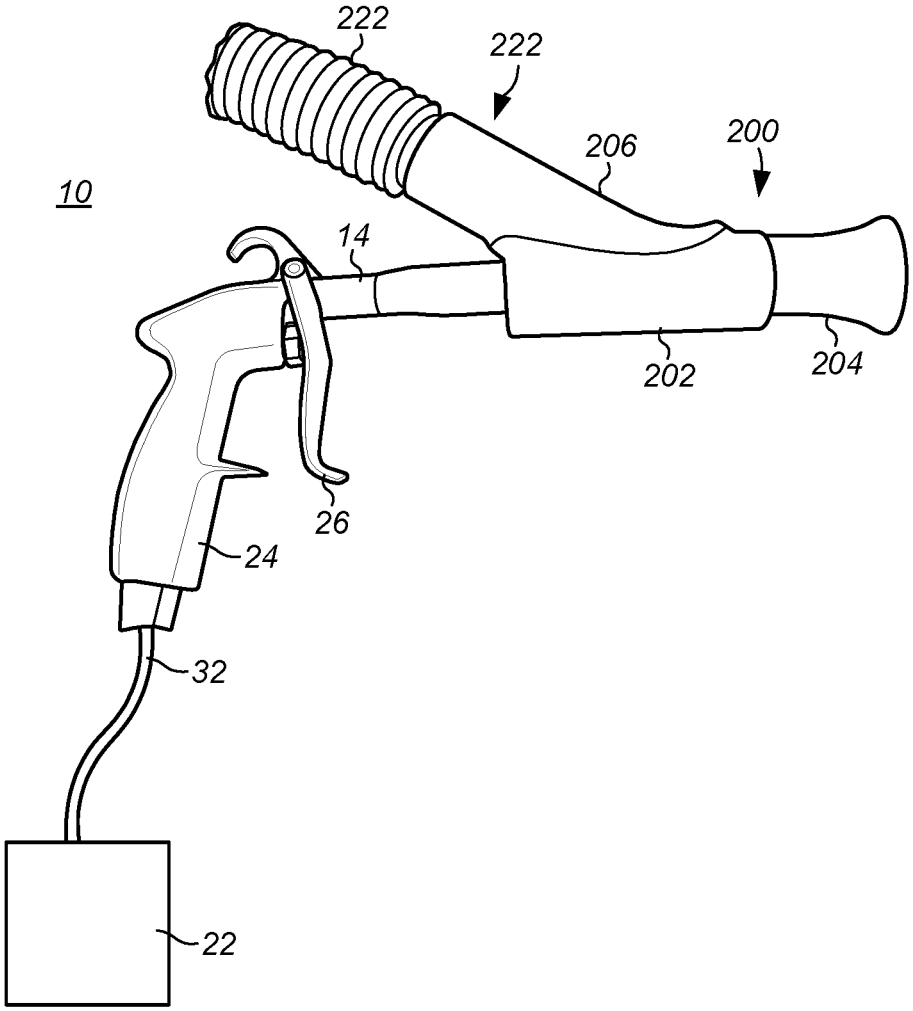
FIG. 16 depicts a perspective view of an embodiment of a spray apparatus with spray nozzle and a vacuum port.
Figure 17:
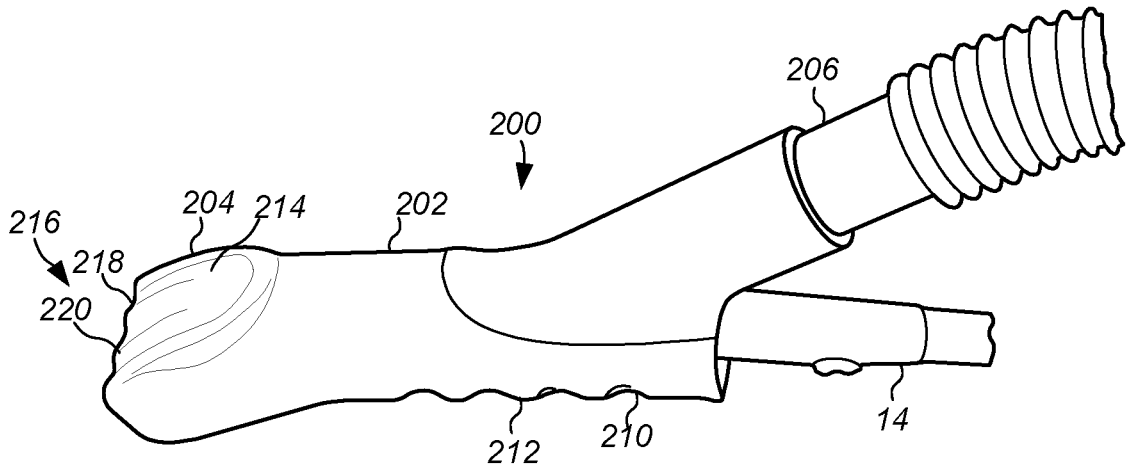
FIG. 17 depicts a perspective side view of an embodiment of the vacuum spray apparatus cover with a vacuum port.
Figure 18:
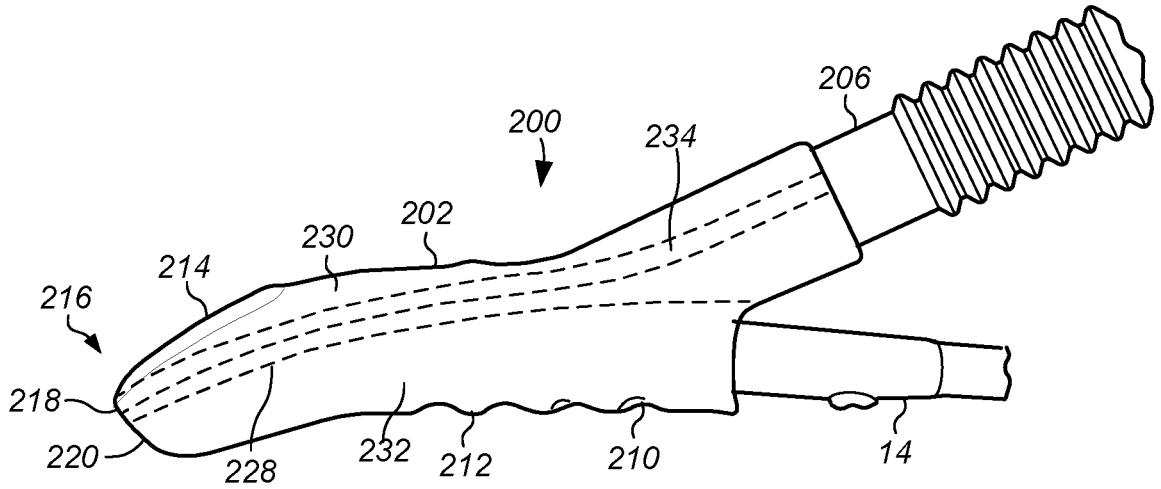
FIG. 18 depicts a perspective side view of another embodiment of the vacuum spray apparatus cover with a vacuum port.
Figure 19:
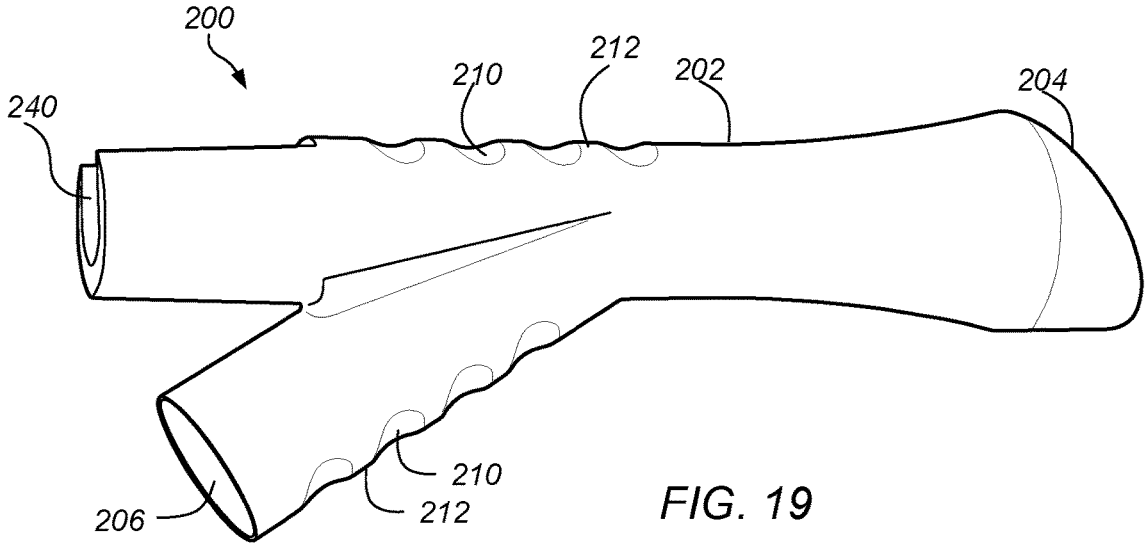
FIG. 19 depicts a perspective side view of another embodiment of the vacuum spray apparatus cover with a vacuum port.
Figure 20:
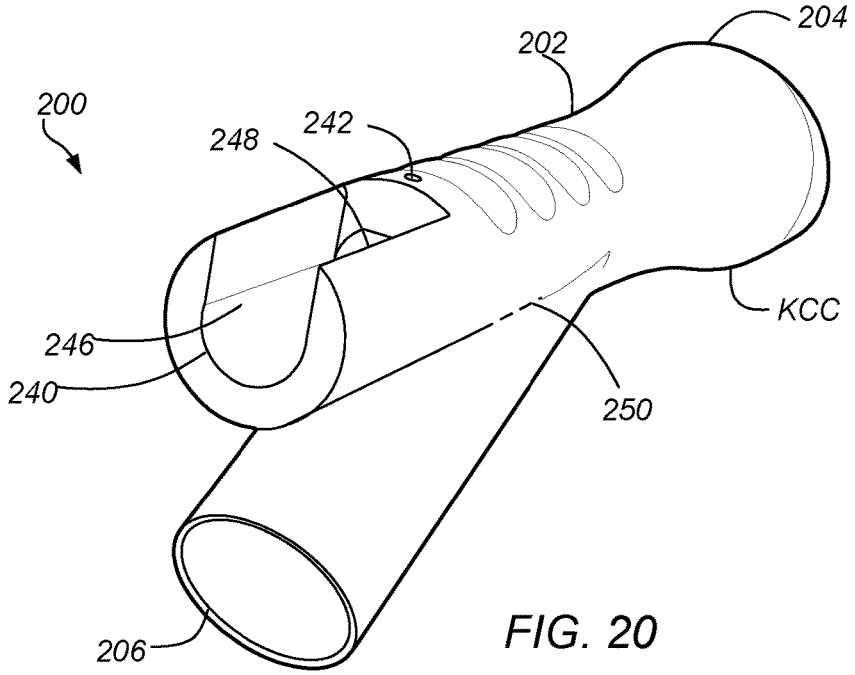
FIG. 20 depicts a perspective bottom view of the vacuum spray apparatus cover of FIG. 19.

FIGS. 14-22 depict embodiments of a spray apparatus capable of removing particles from material using vacuum. FIG. 14A depicts a perspective exploded side view of an embodiment of a spray apparatus with a vacuum port and a medium container. FIG. 14B depicts a perspective side view of the spray apparatus having a rigid conduit assembled. FIG. 15 depicts a perspective side view of the spray apparatus having a flexible conduit assembled. FIG. 16 depicts a perspective view of a spray apparatus with a vacuum port. FIG. 17 depicts a perspective side view of an embodiment of the cover with a vacuum port. FIG. 18 depicts a perspective side view of another embodiment of the cover with a vacuum port. FIG. 19 depicts a perspective side view of an embodiment of a vacuum cover with a vacuum port. FIG. 20 depicts a perspective bottom view of an embodiment of the vacuum cover of FIG. 19. FIGS. 21A-21B depict perspective side views of an embodiment of a sealing member coupled to a vacuum port of the vacuum spray apparatus. FIGS. 22A-22B depict perspective side views of an embodiment of a sealing member coupled to a vacuum port of the vacuum spray apparatus. In FIGS. 14A-14B and 15, spray apparatus 58 and spray apparatus 100 that dispenses medium includes cover 200. In FIG. 16, spray apparatus 10 includes cover 200.

Cover 200 may include body 202, end 204, and vacuum port 206. Body 202 may couple or directly couple to a portion of spray apparatus 10. Body 202 may be directly attached to the spray apparatus (for example, attach to joint 14) and/or be removably attached. Body 202 may include a passage that allows cover 200 to slide onto the spray apparatus (for example, joint 14). Body 202 may be contoured to allow gripping of the cover.

As shown in FIGS. 17, 19, and 22, body 200 includes grooves (indentations) 210 and ridges 212 shaped to contour with a hand of the user. Use of a contoured handle (ergonomic handle) allows distribution of weight from the handle to the grooves.

End 204 may be formed as part of body 202. In some embodiments, end 204 is removably coupled to body 202. For example, end 204 may thread, clip or pressure fit onto or in body 202. Allowing end 204 to be removable, may allow for a variety of attachments to be used (for example, a brush attachment, or crevice tool).

As shown in FIG. 17, end 204 includes beveled portion 214 and contoured portion 216. Beveled portion 214 may be sloped to allow the cover 200 to be positioned at an angle relative to the material. Positioning the cover at an angle may assist in sealing of the cover to the material during application of vacuum to the cover. Beveled portion may include grooves 218 and ridges 220. Grooves 218 and ridges 220 may form contoured portion 216. Grooves 218 and ridges 220 may be used to loosen or dislodge particles from the material. The use of ridges and grooves assists in raking of the material and collection of particles. When contoured portion 216 is positioned on a surface to be cleaned, a space is created between the grooves and the surface. Particles dislodged by contact of the ridges with the material are drawn into cover 200 through the space between the grooves and the material. In some embodiments, end 204 does not include beveled portion 214 and/or contoured portion 216. Other shapes for end 204 may be used. For example, end 204 may be curved, slanted, elongated or other shapes known to assist in loosening or dislodging particles from material.

In some embodiments, body 202 includes wall 228. FIG. 18 depicts cover 200 with wall 228. Wall 228 may separate conduit 206 from joint 14 to form vacuum conduit 230 and fluid conduit 232. Inclusion of wall 228 separates the source of vacuum from the pressurized fluid source. Wall 228 may allow pressurized fluid and/or medium to be applied to a surface through fluid conduit 232, while simultaneously applying vacuum through 230 to remove the particles or medium that are forced out of the material. Vacuum conduit 230 may include grooves or channel 234 that guides removed particulates in into vacuum port 206. Channel 234 may be aligned with contoured portion 216. While only one channel is shown in FIG. 18, more than one channel is contemplated. In some embodiments, wall 228 is not present, but channels 234 are present and vice a versa. For example, dust, dirt, lint, hair and/or water that is forced from by the pressurized fluid from the spray nozzle may be guided through vacuum conduit 230 via channels 234. Wall 228 and channel 234 may be formed as an integral part of cover 200 during the manufacture of the cover.

As shown in FIGS. 14-18 and 19-20, vacuum port 206 extends from body 202. Vacuum port may extend at an angle relative to body 202. For example, vacuum port 206 may extend at an angle ranging from about 1 degree to about 90 degrees, from about 20 degrees to about 80 degrees, or from about 40 degrees to about 60 degrees relative to body 202. In some embodiments, vacuum port 206 extends at about a 45 degree angle relative to body 202. Vacuum port 206 may connect to a vacuum source through conduit 222. Conduit 222 includes flexible portion 224 and substantially rigid portion 226. Having flexible portion 224 may assist in connecting to the vacuum source. Flexible portion may have any type of end fitting that is complementary to a vacuum source fitting. Substantially rigid portion 226 may be smaller in diameter than vacuum port 206 to allow the substantially rigid portion to be inserted into the vacuum port. Substantially rigid portion 226 may frictionally couple to the interior surface of vacuum port 206. In some embodiments, conduit 222 and vacuum port 206 are all one piece. In some embodiments, conduit 222, vacuum port 206, body 202 and end 204 are all one piece. In some embodiments, conduit 222 does not include flexible portion 224. In other embodiments, conduit 222 does not include substantially rigid portion 226.

In some embodiments, vacuum cover 200 includes a slot. As shown in FIGS. 19 and 20 cover 200 includes body 202, end 204, vacuum port 206 and slot 240. Body 202 may couple or directly couple to a portion of spray apparatuses described herein (for example, spray apparatus 10, 58 and 100).

Body 202 may be removably attached to joint 14. Body 202 may include a passage that allows cover 200 to slide onto the spray apparatus (for example, joint 14). Body 202 may be contoured to allow gripping of the cover.

Slot 240 may allow vacuum cover 200 to be removably coupled to joint 14 (not shown). Slot 240 may be formed as an integral part of cover 200. A portion of slot 240 may be complementary to the shape of joint 14 to allow cover 240 to slide along the outer surface of joint 14 and cover at least a portion of joint 14 and/or fixed stationary tube 118 of spray apparatus 100. After cover 200 is positioned around joint 14, the cover may be secured to joint 14 by use of a fastener positioned in opening 242 of the cover. Known fasteners such as a pin, screw or the like may be used. The shape of opening 242 is complementary the type of chosen fastener.

As shown, a portion (for example, a bottom portion) of slot 240 has a substantially flat surface 246. Flat surface 246 may be complementary in shape to a substantially flat surface of spray apparatus (for example, a flat bottom surface of joint 14). When coupled together, at least a portion of the flat surfaces of joint 14 and flat surface of slot 14 frictionally couple the cover to the spray apparatus. Frictionally coupling the cover to the spray apparatus may prevent slippage of the cover and/or rotation of the cover during use. In some embodiments, joint 14 and a surface of slot 240 have other complimentary shapes (for example, round or spherical).

Slot 240 includes opening 248. Opening 248 communicates with the passage of cover 200 (for example, the inside of cover 200). The spray nozzle portion of the spray apparatus may be moved through the slot and into the passage of the cover until the nozzle tip of the spray nozzle is at a desired position inside of end 204. For example, spray nozzle (fixed stationary tube 18, rotating element 36 and fixed pipe 50) portion of spray apparatus 10 may be moved along slot 240 through opening 248 until nozzle tip 40 at a desired position inside cover 240. Once positioned, the cover may be secured by adjustment of fastener 242.

As shown in FIGS. 21-22, end 204 is tapered. Tapering of end 204 may allow a seal to be formed when the end is pressed against a material and vacuum is applied. Tapering of end 204 may also enhance raking or disturbance of the material during use. End 204 may be tapered at an angle between about 10 degrees and 50 degrees. In some embodiments, end 204 has about a 45 degree angle relative to body 202.

Cover 200 may include opening 250. Opening 250 allows vacuum to be created inside cover 200. When cover 200 is assembled with a spray apparatus, an annulus is formed between the spray nozzle and the inner walls of cover 200. Decreasing a pressure through port 206 creates a vacuum or partial vacuum in the annulus, which draws particulate matter into the cover and through port 206.

Figure 21A:
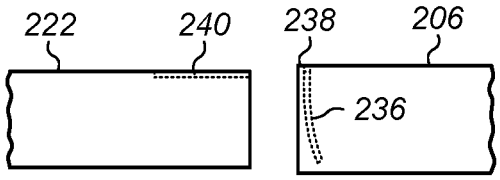
FIGS. 21A and 21B depict perspective views of an embodiment of a sealing member coupled to a vacuum port of the vacuum spray apparatus.
Figure 21B:
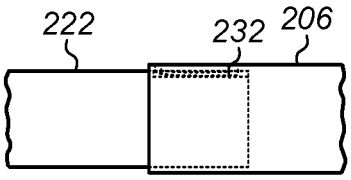

In some embodiments, vacuum port 206 includes sealing member 230. Use of a sealing member allows the portion of vacuum port 206 that connects with the vacuum source to be sealed when the spray apparatus is not connected to a vacuum source. When vacuum port 206 is sealed, the spray nozzle may be connected to air supply 50 and/or medium supply 60. FIGS. 21 and 22 depict embodiments of sealing members for vacuum port 206. FIGS. 21A and 21A depict perspective views of unassembled conduit 222 and vacuum port 206. FIGS. 22B and 22B depict perspective views of conduit 222 inserted inside of vacuum port 206.

In FIG. 21A, conduit 206 includes sealing member 236. Sealing member 236 may connect to a wall of vacuum port 206. Sealing member 236 may be made of material that is capable of being moved when conduit 222 is inserted into vacuum port 206. For example, sealing member may be made of plastic, rubber, or the like. Sealing member 236 may have dimensions that are slightly smaller than opening 238 of vacuum port 206, but sufficient to substantially cover or substantially seal the opening when conduit 222 is not present. Conduit 222 may include groove 240. Groove 240 may have the same dimensions as sealing member 236 to allow the sealing member to lie in the groove when conduit 222 is inserted inside vacuum port 206 as shown in FIG. 21B.

Figure 22A:
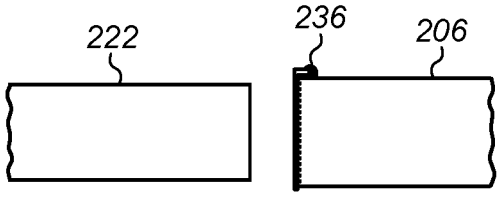
FIGS. 22A and 22B depict a perspective views of another embodiment of a sealing member coupled to a vacuum port of the vacuum spray apparatus.
Figure 22B:
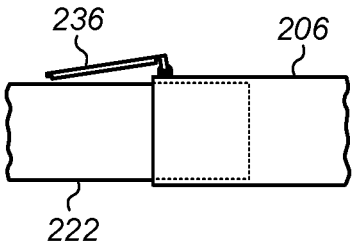

In FIG. 22A, sealing member 236 is coupled, directly coupled, or affixed to an outside wall of vacuum port 206. Sealing member 236 may be lifted and conduit 222 inserted inside vacuum port 206. For example, sealing member 236 is lifted and rigid portion 226 of conduit 222 is inserted into vacuum port 206. Sealing member 236 may include one or more portions that are hinged together to allow the sealing member to be pivoted. In some embodiments, sealing member is made of flexible material that is affixed to wall of vacuum port 206 and, in the closed position, is bent over the edge of the wall to cover opening 232 of the vacuum port. When conduit 222 is inserted in vacuum port 206, a portion of sealing member 236 contacts the outside surface of conduit 222. For example, a portion of sealing member 236 rests on the outside surface of conduit 222 as shown in FIG. 22B.

Other methods of sealing vacuum port 206 are contemplated. For example, vacuum port 206 may include sealing member coupled to the inside portion of the conduit that is automatically or mechanically controlled to open and close.

Figure 23:
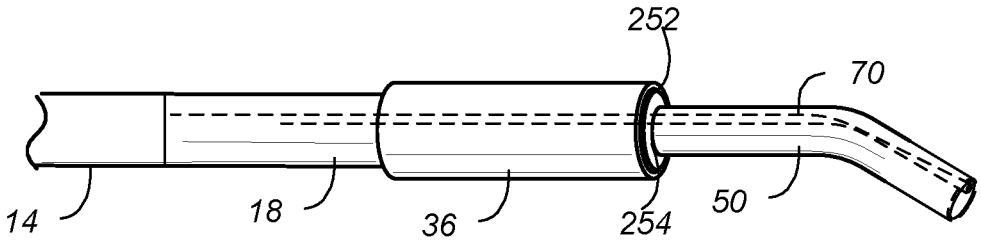
FIG. 23 depicts a perspective side view of an embodiment a spray nozzle that includes a rotating element cover.

In some embodiments, an end of rotating element 36 may include a cover. FIG. 23 depicts an embodiment of a portion of rotating element 36 with cover 252. Rotating element 36 may be open at the distal end and be exposed to fluids and/or dirt used in the process of cleaning one or more material. Covering of this opening may extend the life the rotating elements of the spray nozzle by inhibiting fluid and/or other materials to enter the rotating element. Cover 252 may include opening 254. Pipe 50 may extend through cover 252 through opening 254. During manufacture, cover 252 may be placed over pipe 50 and positioned in the end of rotating element 36. Cover 252 may be press-fit, glued or epoxied to secure the cover in place.

Figure 24:
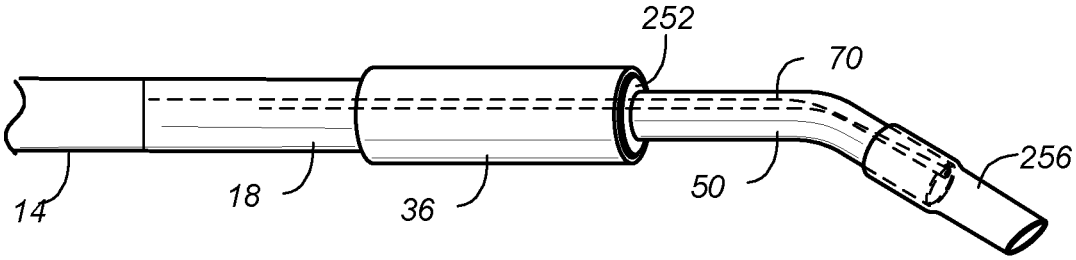
FIG. 24 depicts a perspective side view of an embodiment a spray nozzle that includes a rotating element cover and rigid conduit flexible cover
Figure 25:
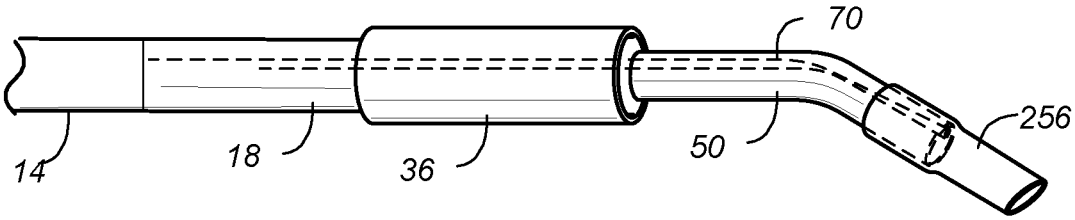
FIG. 25 depicts a perspective side view of an embodiment a spray nozzle that includes a rigid conduit flexible cover.

In some embodiments, a portion of the substantially rigid pipe (conduit) is includes a flexible material (for example, flexible tubing or a flexible hose). FIG. 24 depicts an embodiment of a rigid conduit that includes flexible material and a rotating element cover. FIG. 25 depicts an embodiment of a rigid conduit that includes flexible material. Flexible material 256 may be made of rubber, flexible plastic, polymeric material, or any material that is flexible. Flexible material 256 may be attached or removable attached to the end of pipe 50. For example, flexible material 256 may be a hose that is slide over the end of pipe 50. In some embodiments, flexible material 256 is attached to pipe 50 using heat and/or adhesive. Having a flexible tube on angled end of pipe 50 allows for a more broad cleaning pattern while protecting the end of the pipe 50 (for example, end 50) from being damaged if contact is made between the nozzle and a hard material (for example, stones, pebbles or hard debris).

During use, before or after a material is treated with air and/or medium using spray apparatus 10, spray apparatus 58 or spray apparatus 100, vacuum port 206 of cover 200 is attached to a vacuum source. For example, an end of conduit 222 is inserted in vacuum port 206 and the other end is attached to a vacuum source. End 204 may be positioned near or on a surface of the material and the vacuum source may be turned on. Particles may be drawn into end 204 and, in some embodiments, collected in body 202 of cover 200. In some embodiments, body 202 and/or the vacuum source includes a filter to trap the particles. Contoured portion 216 may be pressed against the material to assist in loosening particles from the material. Contact of the ridges with the material dislodges particles which are pulled into body 202 through grooves 212.

In this patent, certain U.S. patents and other materials (e.g., articles) have been incorporated by reference. The text of such U.S. patents and other materials is, however, only incorporated by reference to the extent that no conflict exists between such text and the other statements and drawings set forth herein. In the event of such conflict, then any such conflicting text in such incorporated by reference U.S. patents and other materials is specifically not incorporated by reference in this patent.

Further modifications and alternative embodiments of various aspects of the invention will be apparent to those skilled in the art in view of this description. Accordingly, this description is to be construed as illustrative only and is for the purpose of teaching those skilled in the art the general manner of carrying out the invention. It is to be understood that the forms of the invention shown and described herein are to be taken as examples of embodiments. Elements and materials may be substituted for those illustrated and described herein, parts and processes may be reversed or omitted, and certain features of the invention may be utilized independently, all as would be apparent to one skilled in the art after having the benefit of this description of the invention. Changes may be made in the elements described herein without departing from the spirit and scope of the invention as described in the following claims. The words "include", "including", and "includes" mean including, but not limited to.

What is claimed is:

1. A method of cleaning materials, comprising:

providing a fluid from a rigid conduit of a spray nozzle apparatus to one or more materials such that one or more compounds are dislodged from the materials, wherein the rigid conduit is substantially arched or angled such that an outlet at a distal end of the conduit is offset from a longitudinal axis of the conduit, wherein the spray nozzle apparatus includes a flexible material coupled to the distal end of the rigid conduit, the flexible material extending outwards from the distal end of the rigid conduit in a direction corresponding to the outlet of the conduit with at least a portion of the flexible material positioned beyond the outlet of the conduit, and wherein a portion of the fluid is provided as an aerosol spray; and reducing a pressure inside the spray nozzle apparatus to a sufficient pressure such that at least one of the dislodged compounds is drawn into the spray nozzle apparatus.

2. The method of claim 1, further comprising providing medium in the fluid to at least one of the materials.

3. The method of claim 1, further comprising stopping the pressure reducing and providing medium in the fluid to at least one of the materials with the spray nozzle apparatus.

4. The method of claim 1, further comprising stopping the pressure reducing and actuating a valve such that medium is provided in the fluid to at least one of the materials with the spray nozzle apparatus.

5. The method of claim 1, wherein providing the aerosol spray portion of fluid comprises actuating a valve such that the fluid flows from a pressurized fluid source through the rigid conduit and onto at least one of the materials as the aerosol spray.

6. The method of claim 1, wherein the materials are in a vehicle or boat interior.

7. The method of claim 1, wherein the materials are carpet materials.

8. The method of claim 1, wherein the materials are vehicle carpet materials.

9. A method of cleaning vehicle interiors, comprising:

providing air from a spray nozzle apparatus to at least one vehicle interior such that one or more compounds are dislodged from a material in the at least one vehicle interior, wherein the spray nozzle apparatus comprises a rigid conduit, the rigid conduit being substantially arched or angled such that an outlet of the rigid conduit is offset a radial distance in a radial direction from a longitudinal axis of the rigid conduit, wherein the air ejected from the outlet rotates the conduit while providing the air, and wherein a flexible material is coupled to a distal end of the rigid conduit, the flexible material extending outwards from the distal end of the rigid conduit in a direction corresponding to the outlet of the conduit with at least a portion of the flexible material positioned beyond the outlet of the conduit; and reducing the pressure inside the spray nozzle apparatus to a sufficient pressure such that at least one of the dislodged compounds is drawn into the spray nozzle apparatus.

10. The method of claim 9, wherein the outlet is substantially at or near the distal end of the rigid conduit, and wherein the pressurized fluid is ejected from the outlet at an oblique angle relative to the longitudinal axis of the rigid conduit.

11. The method of claim 9, further comprising adding a medium to the air provided to the one or more vehicle interiors.

12. The method of claim 9, further comprising stopping the pressure reducing and providing a medium to the one or more vehicle interiors with the spray nozzle apparatus.

13. A method of cleaning one or more materials, comprising:

providing a medium from a spray nozzle apparatus to at least one of the materials such that one or more compounds are dislodged from the material, wherein a portion of the medium is provided as an aerosol spray through a rigid conduit that is substantially arched or angled such that an outlet at a distal end of the conduit is offset from a proximal end of the conduit, wherein the distal end rotates within a cover of the spray nozzle apparatus when medium flows through the rigid conduit, and wherein a flexible material is coupled to the distal end of the rigid conduit, the flexible material extending outwards from the distal end of the rigid conduit in a direction corresponding to the outlet of the conduit and beyond the outlet of the conduit; and reducing a pressure inside a portion of the cover of the spray nozzle apparatus to a sufficient pressure such that at least one of the dislodged compounds is drawn into the cover.

14. The method of claim 13, wherein the medium comprises detergent.

15. The method of claim 13, wherein the medium comprises liquid and/or solid detergent.

16. The method of claim 13, further comprising stopping the pressure reducing and providing additional medium to at least one of the materials with the spray nozzle apparatus.

17. The method of claim 13, wherein the spray nozzle apparatus weighs less than 5 pounds.

* * * * *